US007471262B2

(12) United States Patent
Kim et al.

(10) Patent No.: US 7,471,262 B2
(45) Date of Patent: Dec. 30, 2008

(54) METHOD OF DRIVING PLASMA DISPLAY PANEL

(75) Inventors: Won Jae Kim, Kumi-si (KR); Min Soo Kim, Kumi-si (KR); Ki Duck Cho, Kumi-si (KR); Dae Sik Cho, Kum-si (KR)

(73) Assignee: LG Electronics Inc., Seoul (KR)

( * ) Notice: Subject to any disclaimer, the term of this patent is extended or adjusted under 35 U.S.C. 154(b) by 657 days.

(21) Appl. No.: 10/958,254

(22) Filed: Oct. 6, 2004

(65) Prior Publication Data

US 2005/0073482 A1 Apr. 7, 2005

(30) Foreign Application Priority Data

Oct. 7, 2003 (KR) ..... 10-2003-0069469

(51) Int. Cl.
*G09G 3/28* (2006.01)

(52) U.S. Cl. ..... 345/60; 313/583

(58) Field of Classification Search ..... 345/60, 345/63, 66, 67–72; 313/583
See application file for complete search history.

(56) References Cited

U.S. PATENT DOCUMENTS

| | | | | |
|---|---|---|---|---|
| 6,252,568 | B1 * | 6/2001 | Iseki et al. | 345/60 |
| 6,731,256 | B2 * | 5/2004 | Lin | 345/66 |
| 2002/0008680 | A1 * | 1/2002 | Hashimoto et al. | 345/63 |
| 2004/0021622 | A1 * | 2/2004 | Nagao et al. | 345/60 |
| 2004/0027073 | A1 * | 2/2004 | Nomoto et al. | 313/583 |
| 2004/0056827 | A1 * | 3/2004 | Hsu et al. | 345/60 |
| 2004/0164930 | A1 * | 8/2004 | Hashimoto et al. | 345/60 |

* cited by examiner

*Primary Examiner*—Amare Mengistu
*Assistant Examiner*—Yuk Chow
(74) *Attorney, Agent, or Firm*—Ked & Associates LLP

(57) ABSTRACT

A method of driving a plasma display panel for generating a stable sustain discharge is disclosed. In the method, first sustaining pulses are applied to the scan electrodes such that a sustain discharge can be generated. Second sustaining pulse are applied to the sustain electrodes in such a manner to be alternated with the first sustaining pulses. A stabilization pulse is applied to an address electrode provided alternately with the scan electrode for each discharge cell such that said sustain discharge can be generated via a surface-discharge area of a voltage close curve.

28 Claims, 25 Drawing Sheets

METHOD OF DRIVING PLASMA DISPLAY PANEL

This application claims the benefit of Korean Patent Application No. P2003-69469 filed in Korea on Oct. 7, 2003, which is hereby incorporated by reference.

BACKGROUND OF THE INVENTION

1. Field of the Invention

This invention relates to a plasma display panel, and more particularly to a method of driving a plasma display panel that is adaptive for generating a stable sustain discharge.

2. Description of the Related Art

Generally, a plasma display panel (PDP) radiates a phosphorous material using an ultraviolet ray with a wavelength of 147 nm generated upon discharge of an inactive mixture gas such as He+Xe, Ne+Xe or He+Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

Referring to FIG. 1, a discharge cell of the conventional three-electrode, AC surface-discharge PDP includes a scan electrode Y and a sustain electrode Z provided on an upper substrate 10, and an address electrode X provided on a lower substrate 18. The scan electrode Y and the sustain electrode Z include transparent electrodes 12Y and 12Z, and metal bus electrodes 13Y and 13Z having a smaller line width than the transparent electrodes 12Y and 12Z and provided at one edge of the transparent electrodes 12Y and 12Z, respectively.

The transparent electrodes 12Y and 12Z are usually formed from indium-tin-oxide (ITO) on the upper substrate 10. The metal bus electrodes 13Y and 13Z are usually formed from a metal such as chrome (Cr) on the transparent electrodes 12Y and 12Z to thereby reduce a voltage drop caused by the transparent electrodes 12Y and 12Z having a high resistance. On the upper substrate 10 provided with the scan electrode Y and the sustain electrode Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode X. The surfaces of the lower dielectric layer 22 and the barrier ribs 24 are coated with a phosphorous material layer 26. The address electrode X is formed in a direction crossing the scan electrode Y and the sustain electrode Z. The barrier rib 24 is arranged in parallel to the address electrode X to thereby prevent an ultraviolet ray and a visible light generated by a discharge from being leaked to the adjacent cells. The phosphorous material layer 26 is excited by an ultraviolet ray generated during the plasma discharge to generate any one of red, green and blue visible light rays. An inactive mixture gas is injected into a discharge space defined between the upper/lower substrates 10 and 18 and the barrier rib 24.

Such a PDP makes a time-divisional driving of one frame, which is divided into various sub-fields having a different emission frequency, so as to realize gray levels of a picture. Each sub-field is again divided into an initialization period for initializing the entire field, an address period for selecting a scan line and selecting the cell from the selected scan line and a sustain period for expressing gray levels depending on the discharge frequency.

Herein, the initialization period is again divided into a set-up interval supplied with a rising ramp waveform and a set-down interval supplied with a falling ramp waveform. For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period is increased at a ratio of $2^n$ (wherein n=0, 1, 2, 3, 4, 5, 6 and 7) at each sub-field.

FIG. 3 shows a driving waveform of the PDP applied to two sub-fields.

Referring to FIG. 3, the PDP is divided into an initialization period for initializing the full field, an address period for selecting a cell, and a sustain period for sustaining a discharge of the selected cell for its driving.

In the initialization period, a rising ramp waveform Ramp-up is simultaneously applied to all the scan electrodes Y in the set-up interval. This rising ramp waveform Ramp-up causes a weak discharge within cells at the full field to generate wall charges within the cells. In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge.

Meanwhile, a positive direct current voltage having a sustain voltage level Vs is applied to the sustain electrodes Z during the set-down interval and the address period.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrodes Y and the sustain electrode Z whenever each sustain pulse sus is applied. Finally, after the sustain discharge was finished, an erasing ramp waveform erase having a small pulse width is applied to the sustain electrode Z to thereby erase wall charges left within the cells.

Hereinafter, a principle of generating the wall charges and the discharge in the sustain period will be described with the aid of a voltage close curve having a hexagonal shape as shown in FIG. 4. Herein, the voltage close curve is used as a scheme for measuring a discharge generation principle and a voltage margin of the PDP.

In FIG. 4, a hexagon area at the interior of the voltage close curve is a region where wall charges at the interior of the discharge cell are distributed. A discharge is not generated at said region. Further, Y(−) represents a motion direction of wall charges when a negative voltage is applied to the scan electrode Y. Similarly, Y(+), X(+), X(−), Z(+) or Z(−) represents a motion direction of wall charges when a negative or positive voltage is applied to the scan electrode Y or the sustain electrode Z.

An operation procedure in the sustain period will be described below.

At the discharge cells where the address discharge has been generated, wall charges are located at the third quarter-face of the graph as shown in FIG. 4.

Thereafter, if a positive sustaining pulse is applied to the scan electrode Y as shown in FIG. 3, then a voltage of wall charges positioned at the third quarter-face is added to a voltage of the positive sustaining pulse, thereby moving the added voltage value via a surface-discharge area positioned at the third quarter-face of the graph (i.e., into the Y(+) axis) as shown in FIG. 5. In this case, a sustain discharge between the scan electrode Y and the sustain electrode Z is generated at the discharge cells.

After the sustain discharge was generated, the wall charges are positioned at the first quarter-face of the graph as shown in FIG. 6. Further, a voltage of wall charges positioned at the first quarter-face is added to a voltage of the positive sustaining pulse by a positive sustaining pulse applied to the sustain electrode Z, thereby moving the added voltage value via a surface-discharge area positioned at the first quarter-face (i.e., into the Z(+) axis) as shown in FIG. 6. In this case, a sustain discharge between the sustain electrode Z and the scan electrode Y is generated at the discharge cells. In real, the PDP repeats the foregoing process during the sustain period to thereby cause a predetermined frequency of sustain discharges.

However, the conventional PDP has a problem in that an opposition discharge is caused in the sustain period by an non-uniformity of the PDP cells. More specifically, the PDP has been generally manufactured into a large-dimension panel of approximately more than 42 inches. In this case, a thickness of the phosphorous material, a height of the barrier rib and the like is somewhat changed for each position thereof by a process tolerance. If the discharge cells are formed non-uniformly as mentioned above, a position (or wall voltage) of the wall charges having generated the address discharge is established differently for each discharge cell. In real, at specific discharge cells, wall charges are located at the lower side of the third quarter-face of the graph as shown in FIG. 7 after the address discharge was generated.

If wall charges at the specific discharge cell are positioned at the lower side of the third quarter-face of the graph as shown in FIG. 7, then a voltage value of the discharge cell is moved via an opposition discharge area positioned at the third quarter-face (i.e., into the Y(+) axis) as shown in FIG. 8 by a positive sustaining pulse applied to the scan electrode Y. In this case, at the discharge cells, an opposition discharge is generated between the scan electrode Y and the address electrode X. If an opposition discharge is generated between the scan electrode Y and the address electrode X, then an amount of a light generated from the discharge is reduced and the discharge is erased because the wall charges are not moved into a desired place after the opposition discharge. In other words, the conventional PDP has a problem in that a stable sustain discharge can not be generated from the specific discharge cells.

Meanwhile, there has been suggested a strategy of raising a voltage value of the data pulse data for a high-speed addressing of the PDP. However, since an operation margin of a driving voltage has been limited in the prior art, it is difficult to raise a voltage value of the data pulse data. More specifically, when a voltage value of the data pulse data is not raised, the data pulse data has a first voltage Vdata1 (i.e., approximately 60 to 80V).

If the first voltage Vdata1 is applied, then a voltage of the discharge cell is moved, from the interface portion of the surface-discharge area of the first quarter-face where the wall voltage is positioned, via an opposition discharge area of the first quarter-face (i.e., into the X(+) axis) as shown in FIG. 9. In this case, at the discharge cells, an opposition discharge is generated between the scan electrode Y and the address electrode X. Thereafter, the wall charges are moved into a place 30 being adjacent to the surface-discharge area of the third quarter-face. Herein, if the wall charges are moved into the place 30 being adjacent to the surface-discharge area of the third quarter-face, then a stable sustain discharge can be generated.

If a data pulse data having a second voltage Vdata2 (i.e., more than 80V) higher than the first voltage Vdata1 is applied for the sake of a high-speed addressing operation, then a voltage of the discharge cell is moved, from the interface portion of the surface-discharge area of the first quarter-face at which the wall charge is positioned, via the opposition discharge area of the first quarter-face (i.e., into the X(+) axis). In this case, at the discharge cells, an address discharge is generated between the scan electrode Y and the address electrode X. Herein, since the data pulse data has the second voltage Vdata2, the wall charges are moved into a place 32 being adjacent to the opposition discharge area of the third quarter-face. In other words, the prior art has a problem in that, since a probability of generating an opposition discharge in the sustain period is increased as shown in FIG. 8 when a voltage value of the data pulse data is raised for the sake of making a high-speed addressing, it is difficult to cause a stable sustain discharge.

SUMMARY OF THE INVENTION

Accordingly, it is an object of the present invention to provide a method of driving a plasma display panel that is adaptive for generating a stable sustain discharge.

In order to achieve these and other objects of the invention, a method of driving a plasma display panel, in which each of a plurality of discharge cells has a scan electrode and a sustain electrode arranged in parallel to each other, according to an embodiment of the present invention includes the steps of applying first sustaining pulses to the scan electrodes such that a sustain discharge can be generated; applying second sustaining pulse to the sustain electrodes in such a manner to be alternated with the first sustaining pulses; and applying a stabilization pulse to an address electrode provided alternately with the scan electrode for each discharge cell such that said sustain discharge can be generated via a surface-discharge area of a voltage close curve.

In the method, said stabilization pulse overlaps with a portion of the first sustaining pulse firstly applied to the scan electrode.

Herein, said stabilization pulse is applied prior to the firstly-applied first sustaining pulse.

Said stabilization pulse is synchronized with the first sustaining pulse applied to the scan electrode.

Said stabilization pulse is applied prior to the first sustaining pulse in such a manner to be not overlapped with the first sustaining pulse applied to the scan electrode.

Said stabilization pulse has a positive voltage.

The number of said stabilization pulses is equal to the number of the plurality of first sustaining pulses applied to the scan electrodes.

Said stabilization pulse overlaps with a portion of the first sustaining pulse.

Said stabilization pulse is applied prior to the first sustaining pulses.

Said stabilization pulse is synchronized with the first sustaining pulse.

Said first sustaining pulse firstly applied to the scan electrode overlaps with a partial interval of said stabilization pulse, whereas the remaining first sustaining pulses other than said firstly-applied first sustaining pulse are synchronized with said stabilization pulse.

The method further includes the step of applying a data pulse to the address electrode in order to select a discharge cell at which said sustain discharge is generated before generation of said sustain discharge.

A method of driving a plasma display panel, in which each of a plurality of discharge cells has a scan electrode and a sustain electrode arranged in parallel to each other and an address electrode provided alternately with the scan electrode, according to another embodiment of the present invention includes the step of repetitively applying negative and positive sustaining pulses to the sustain electrode such that a sustain discharge can be generated, via a surface-discharge area of a voltage close curve, during a sustain period.

In the method, said negative sustaining pulse is applied as a first pulse in said sustain period.

The scan electrode and the address electrode maintain a ground potential during said sustain period.

Said negative sustaining pulse and said positive sustaining pulse have the same absolute voltage value.

A method of driving a plasma display panel, in which each of a plurality of discharge cells has a scan electrode and a sustain electrode arranged in parallel to each other, according to still another embodiment of the present invention includes the steps of applying first negative sustaining pulses to the sustain electrodes such that a sustain discharge can be generated, via a surface-discharge area of a voltage close curve, during a sustain period; and applying second negative sustaining pulse to the scan electrodes in such a manner to be alternated with the first sustaining pulse.

In the method, said first sustaining pulse and said second sustaining pulse have the same voltage value.

A method of driving a plasma display panel, in which each of a plurality of discharge cells has a scan electrode and a sustain electrode arranged in parallel to each other, still another embodiment of the present invention includes the steps of applying first positive sustaining pulses to the scan electrodes such that a sustain discharge can be generated; applying second positive sustaining pulse to the sustain electrodes in such a manner to be alternated with the first sustaining pulses; and applying a stabilization pulse to the sustain electrode such that said sustain discharge can be generated via a surface-discharge area of a voltage close curve.

In the method, said stabilization pulse has a negative potential.

Herein, an absolute voltage value of said stabilization pulse is set to be lower than those of said first and second sustaining pulse.

Said stabilization pulse overlaps with a portion of the first sustaining pulse.

Said stabilization pulse is applied prior to the first sustaining pulse.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 10 to 19B.

Figure 10:
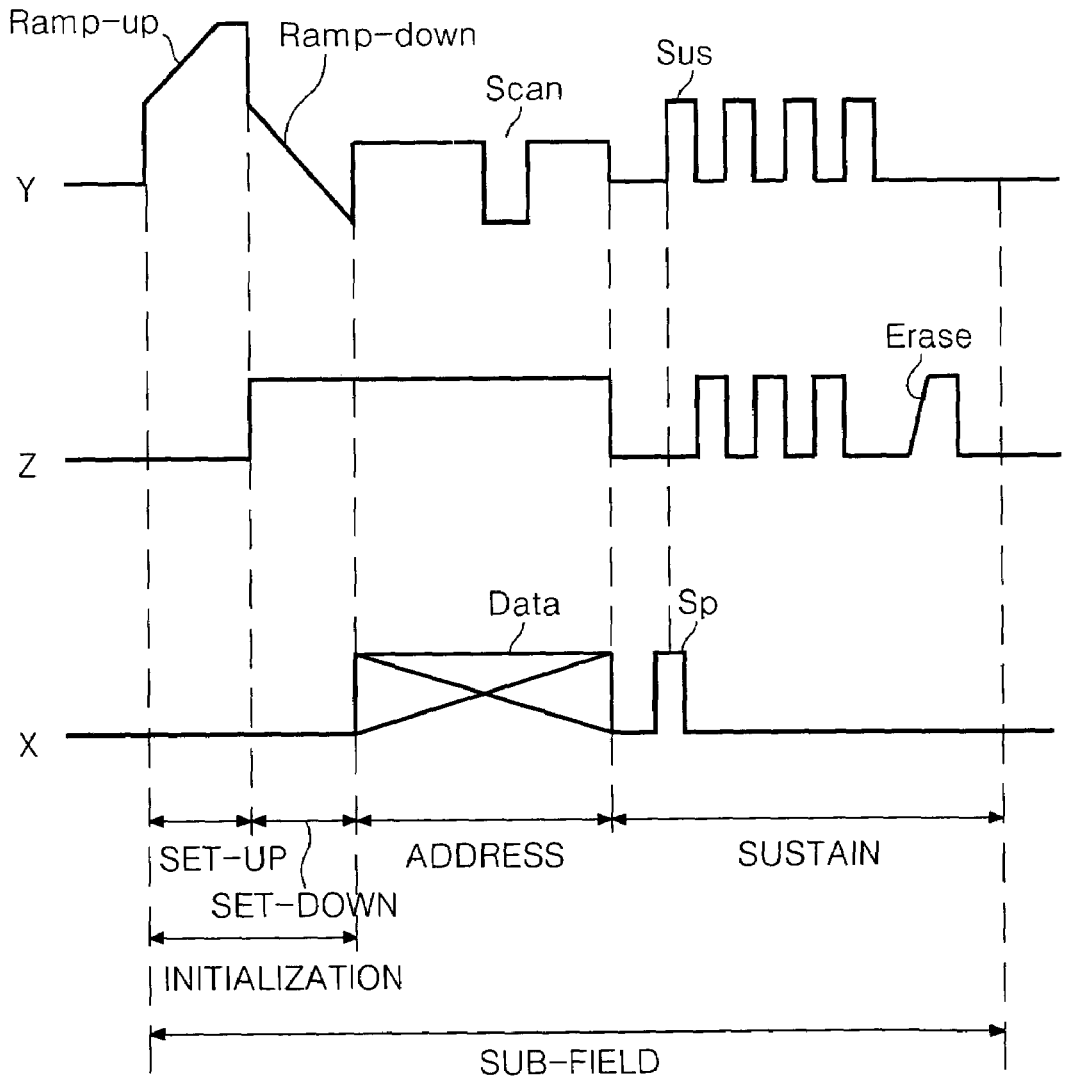
FIG. 10 is a waveform diagram for explaining a method of driving a plasma display panel according to a first embodiment of the present invention.

FIG. 10 is a waveform diagram for explaining a method of driving a plasma display panel according to a first embodiment of the present invention.

Referring to FIG. 10, a sub-field of the PDP is divided into an initialization period for initializing the full field, an address period for selecting a cell, and a sustain period for sustaining a discharge of the selected cell for its driving.

In the initialization period, a rising ramp waveform Ramp-up is simultaneously applied to all the scan electrodes Y in the set-up interval. This rising ramp waveform Ramp-up causes a weak discharge within cells at the full field to generate wall charges within the cells. In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge.

Meanwhile, a positive direct current voltage having a sustain voltage level Vs is applied to the sustain electrodes Z during the set-down interval and the address period.

In the sustain period, a sustaining pulse sus is alternately applied to the scan electrodes Y and the sustain electrodes Z. Further, a stabilization pulse SP overlapping with the first sustaining pulse is applied to the address electrode X. Herein, the stabilization pulse SP applied to the address electrode X precedes the first sustaining pulse applied to the scan electrodes Y. If the stabilization pulse SP overlapping with the first sustaining pulse is applied to the address electrode X, a stable sustain discharge having a surface-discharge type is generated in the sustain period.

Hereinafter, this will be described in detail with the aid of voltage close curves shown in FIG. 11A and FIG. 11B. In the voltage close curve, Y(−) represents a motion direction of the wall voltage when a negative voltage is supplied to the scan electrode Y. Similarly, Y(+), X(+), X(−), Z(+) or Z(−) represents a motion direction of wall charges when a negative or positive voltage is applied to the scan electrode Y or the sustain electrode Z.

Firstly, a case where wall charges formed by the address discharge are moved into a predetermined place 40 of the third quarter-face of the graph will be described with reference to FIG. 11A. In the address period, a stabilization pulse SP is applied to the address electrode X. Herein, a voltage of the stabilization pulse SP is set to be equal to or lower than that of the data pulse data. If the stabilization pulse SP is applied to the address electrode X, then a voltage of wall charges positioned at the third quarter-face is added to a voltage of the positive stabilization pulse SP, thereby moving the wall voltage into a place 42 at the Y axis of the graph (i.e., into the X(+) axis). Further, the wall charge of the discharge cell is moved via the surface-discharge area positioned at the third quarter-face of the graph (i.e., into the Y(+) axis by the first sustaining pulse applied in such a manner to overlap with the stabilization pulse SP. In this case, at the discharge cells, a sustain discharge is generated between the scan electrode Y and the sustain electrode Z.

Figure 1:
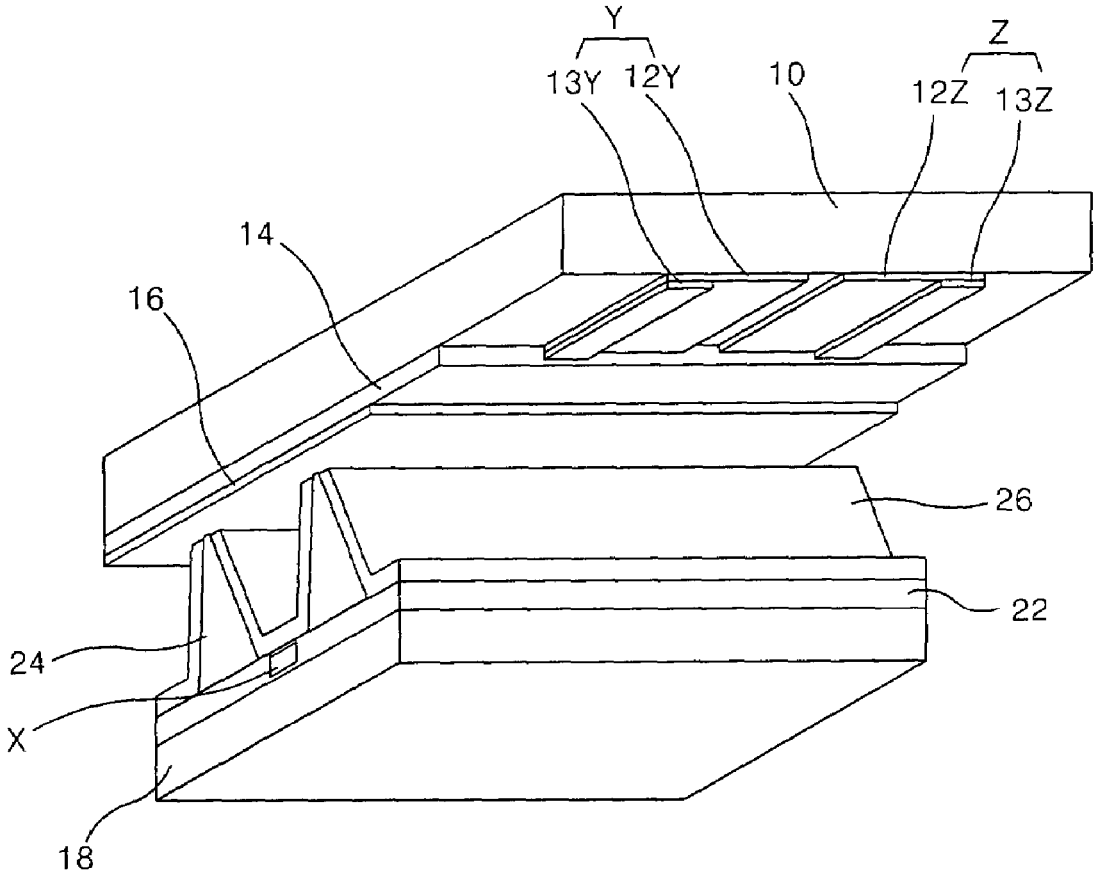
FIG. 1 RELATED ART
FIG. 1 is a perspective view showing a discharge cell structure of a conventional three-electrode, AC surface-discharge plasma display panel.
Figure 2:
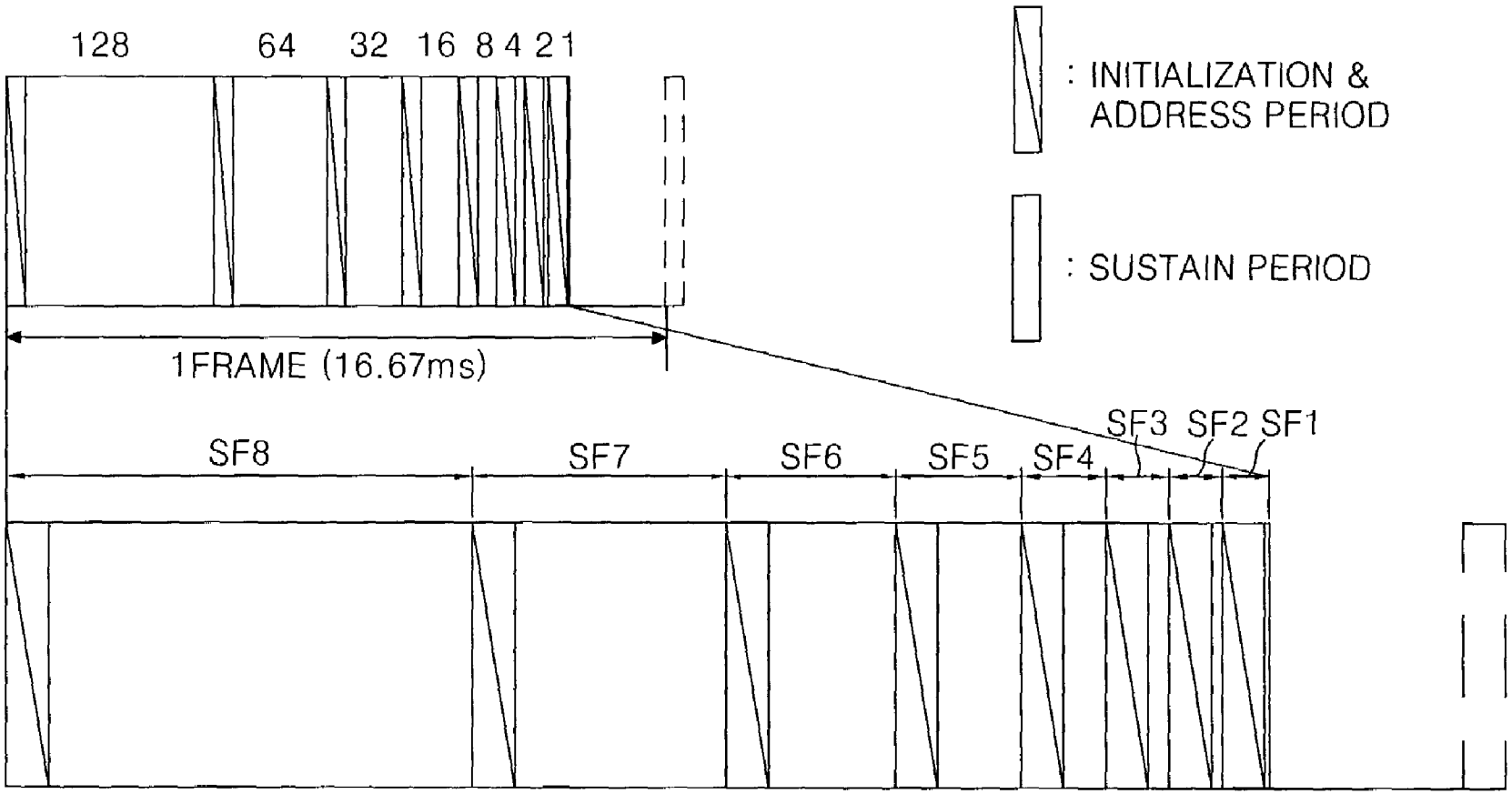
FIG. 2 RELATED ART
FIG. 2 illustrates one frame of the conventional plasma display panel.
Figure 3:
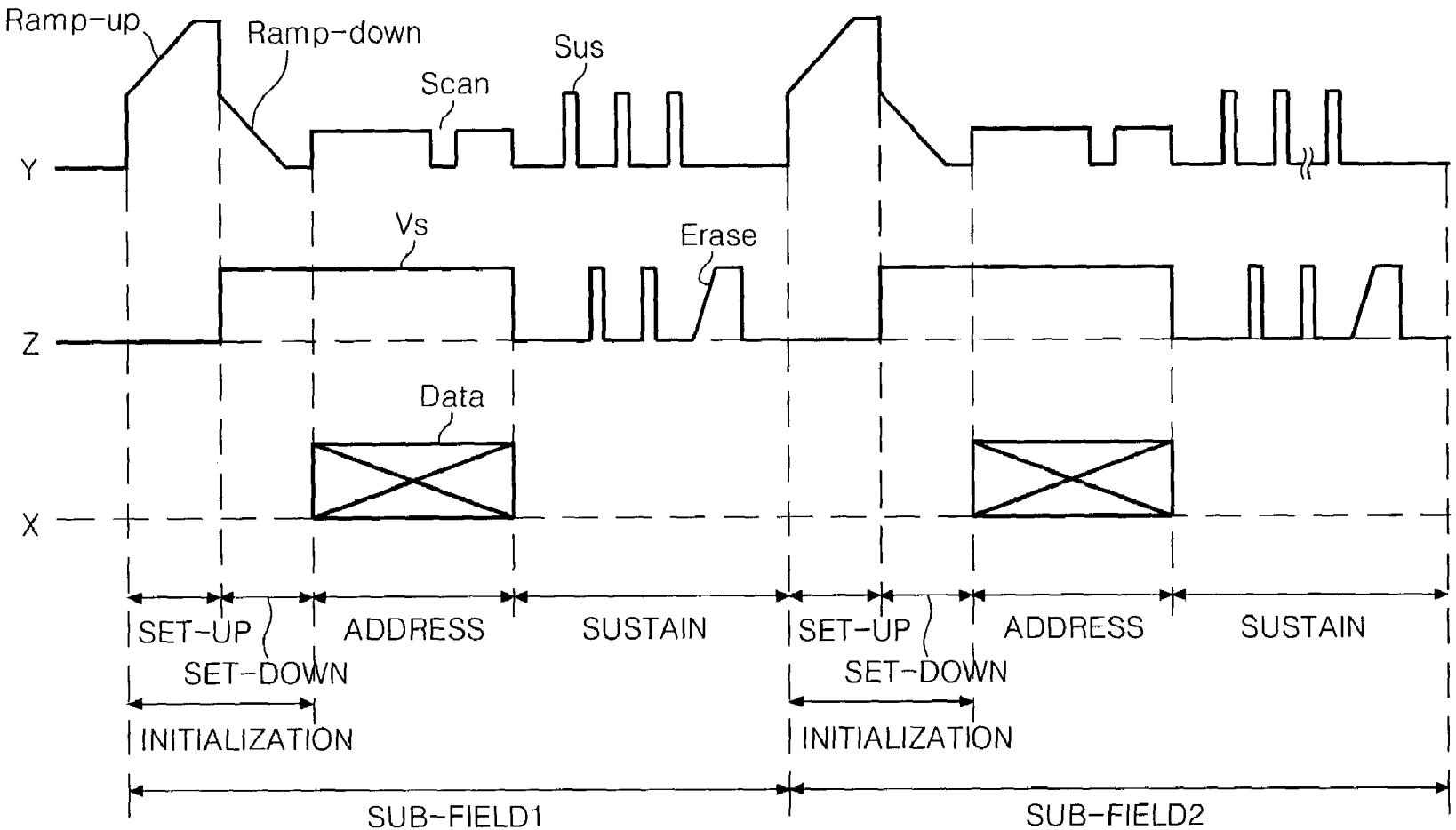
FIG. 3 RELATED ART
FIG. 3 is a waveform diagram of driving signals supplied to the electrodes during the sub-fields shown in FIG. 2.
Figure 4:
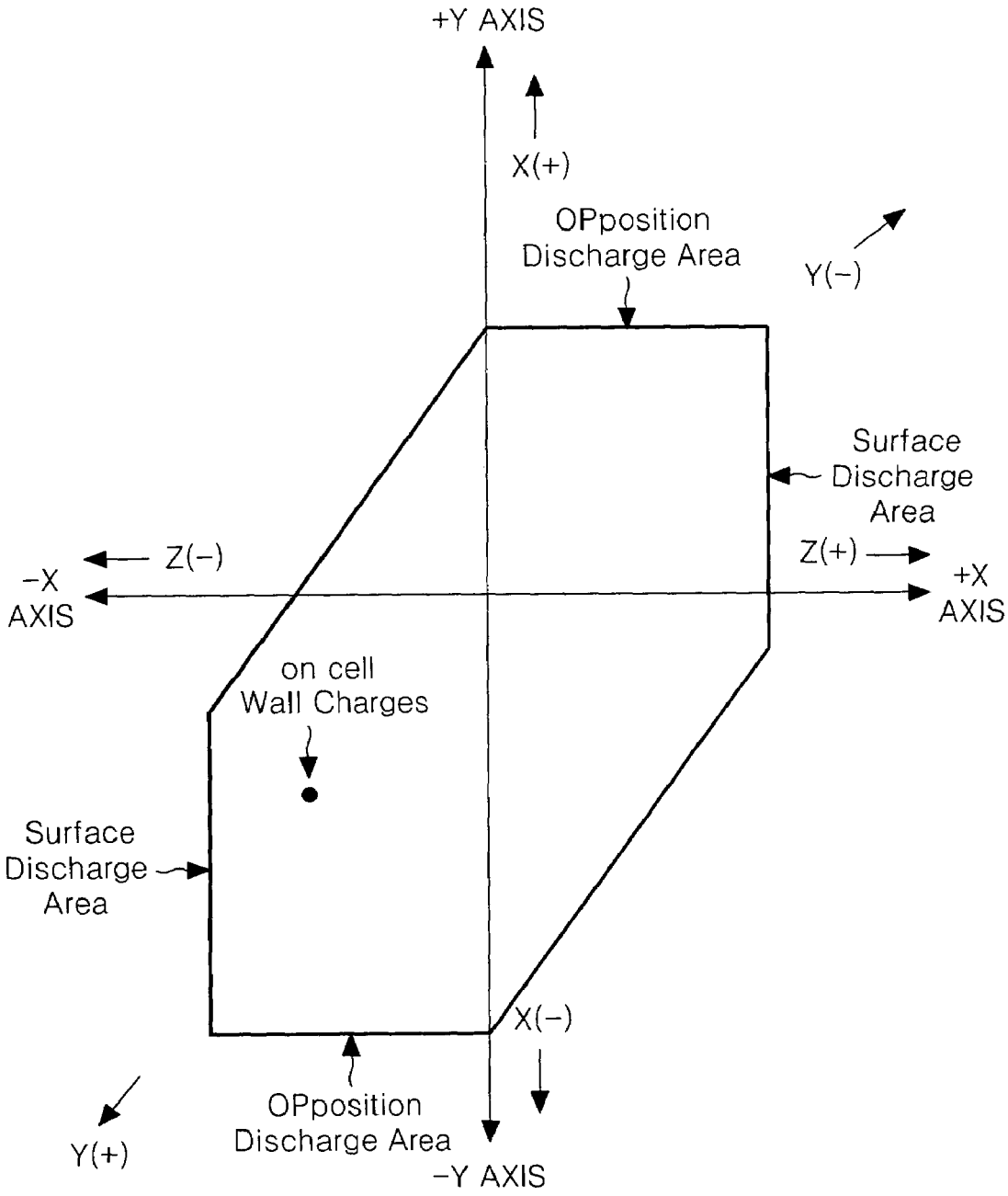
FIG. 4 RELATED ART
FIG. 4 is a graph showing a position of the wall charges at the discharge cell having generated the address discharge.
Figure 5:
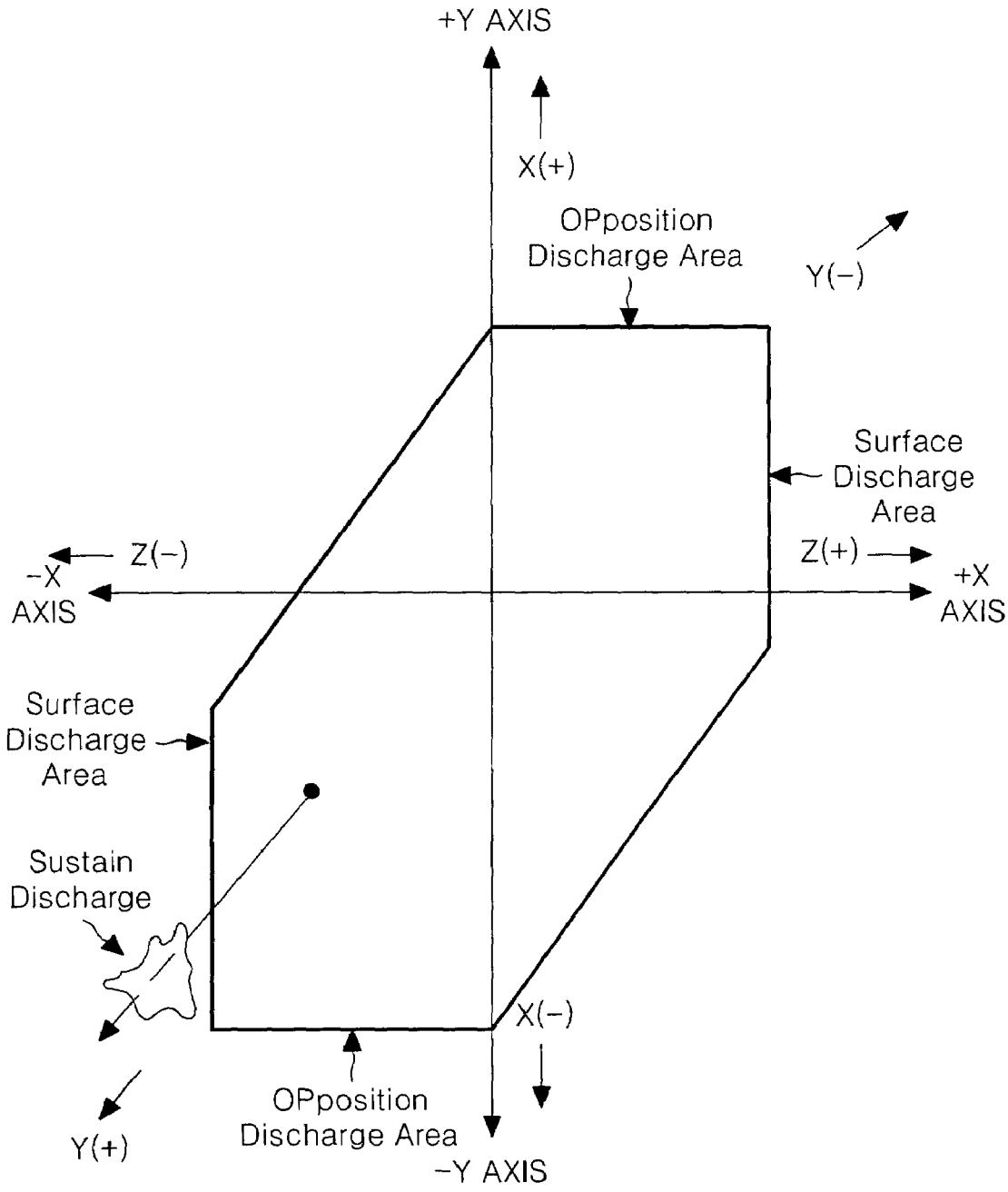
FIG.5 RELATED ART
FIG. 5 is a graph showing a process of generating the sustain discharge when a sustaining pulse is applied to the wall charges shown in FIG. 4.
Figure 6:
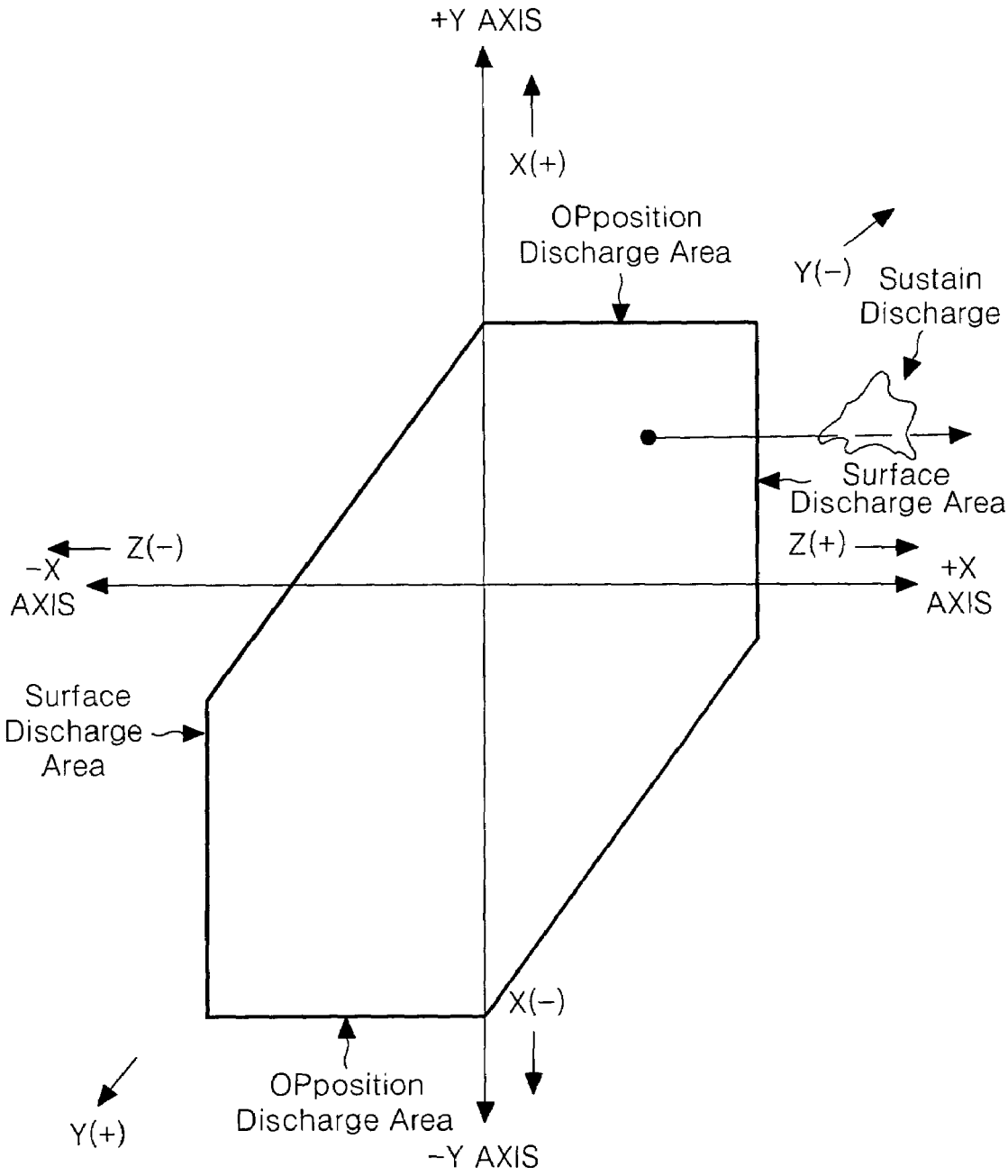
FIG.6 RELATED ART
FIG. 6 is a graph showing a position of the wall charges formed by the sustain discharge in FIG. 5.
Figure 7:
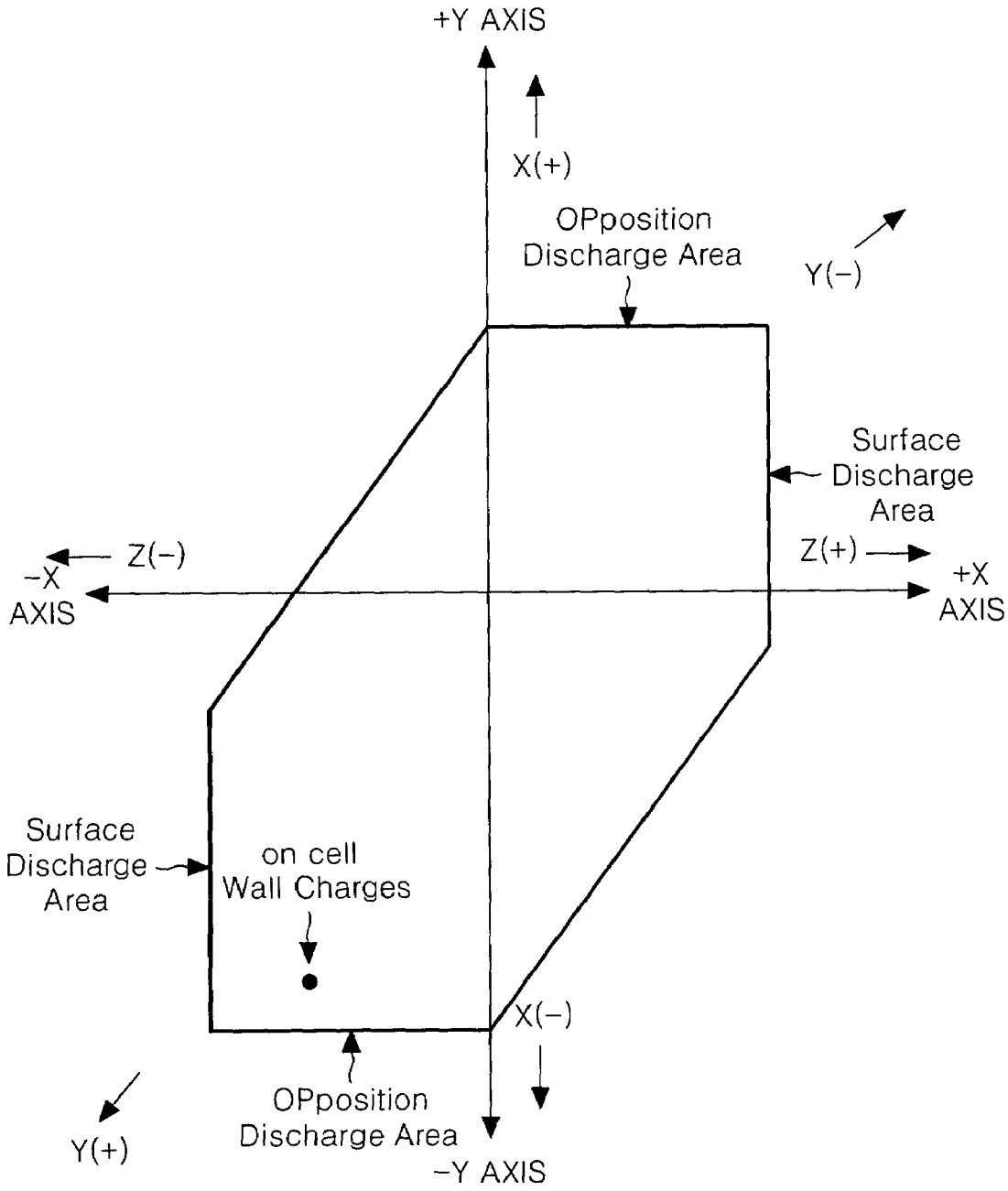
FIG. 7 RELATED ART
FIG. 7 is a graph showing a position of the wall charges after the address discharge was generated when the discharge cells are formed non-uniformly.
Figure 8:
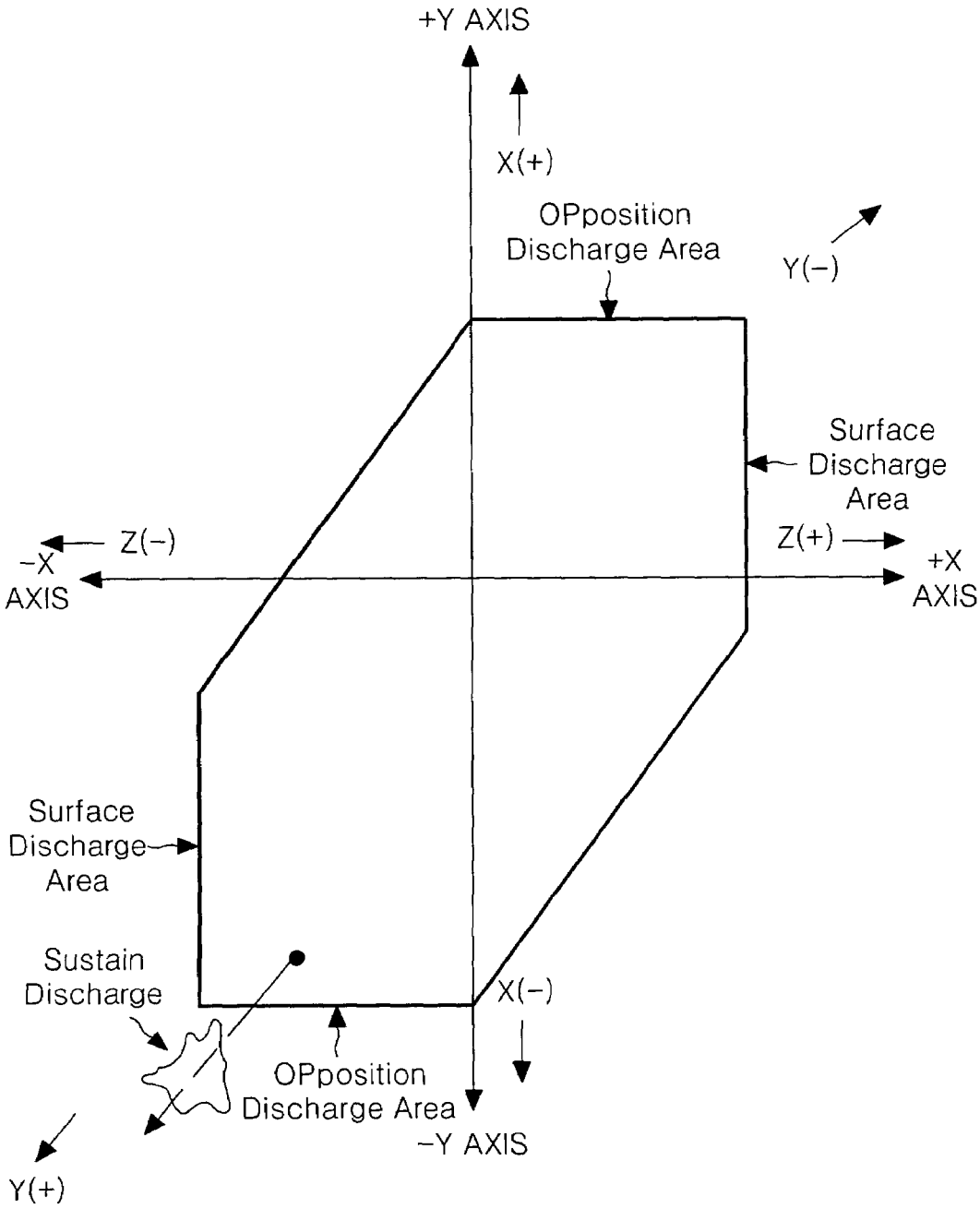
FIG. 8 RELATED ART
FIG. 8 is a graph showing a process of generating the sustain discharge when a sustaining pulse is applied to the wall charges shown in FIG. 4.
Figure 9:
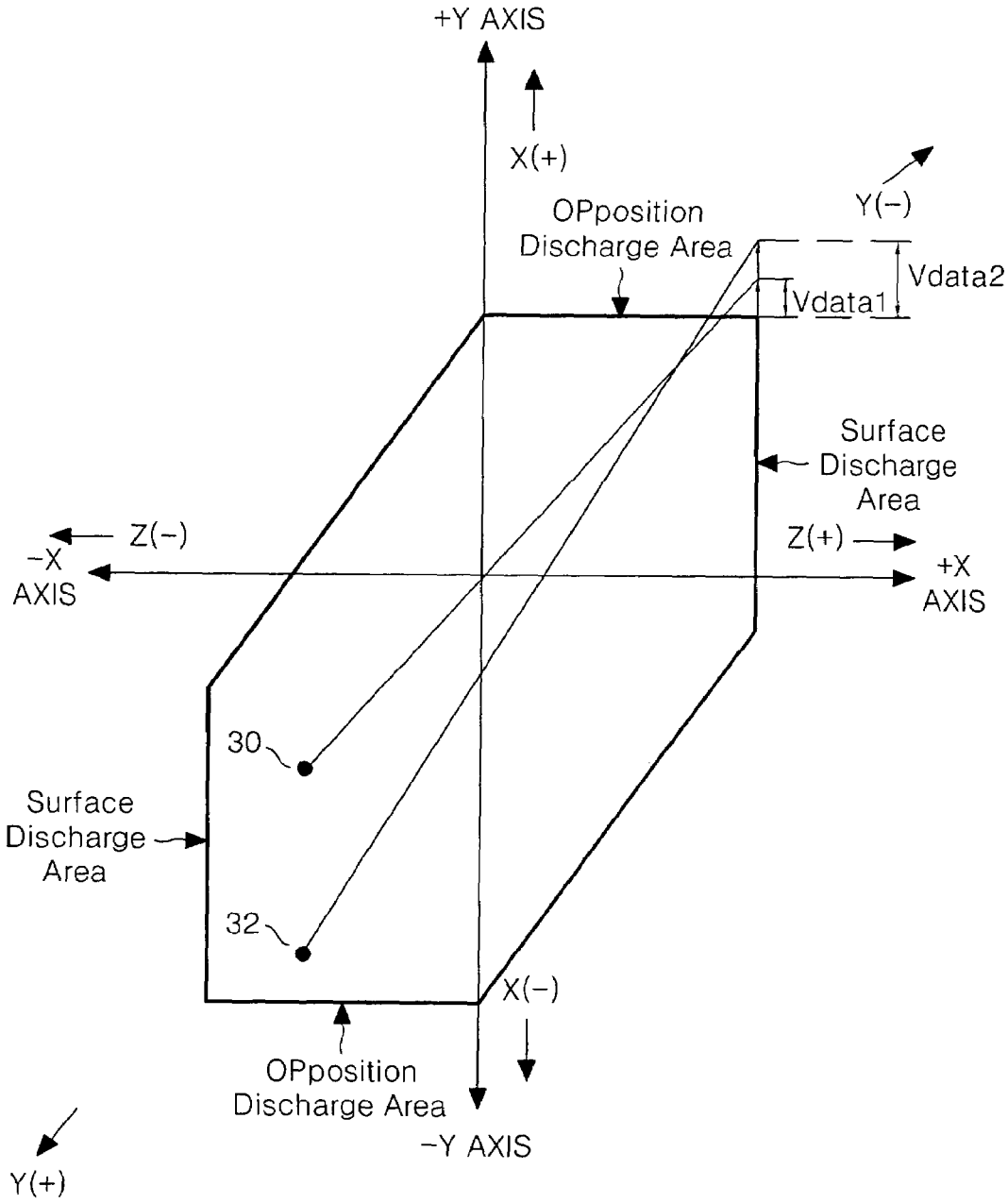
FIG.9 RELATED ART
FIG. 9 is a graph showing a position of the wall charges moved in correspondence with a voltage value of the data pulse applied to the address period.

If a sustain discharge having a surface-discharge type is generated at the discharge cells as mentioned above, then the wall charges of the discharge cell are moved into a desired place of the first quarter-face of the graph as shown in FIG. 6, thereby causing a stable sustain discharge.

Figure 11A:
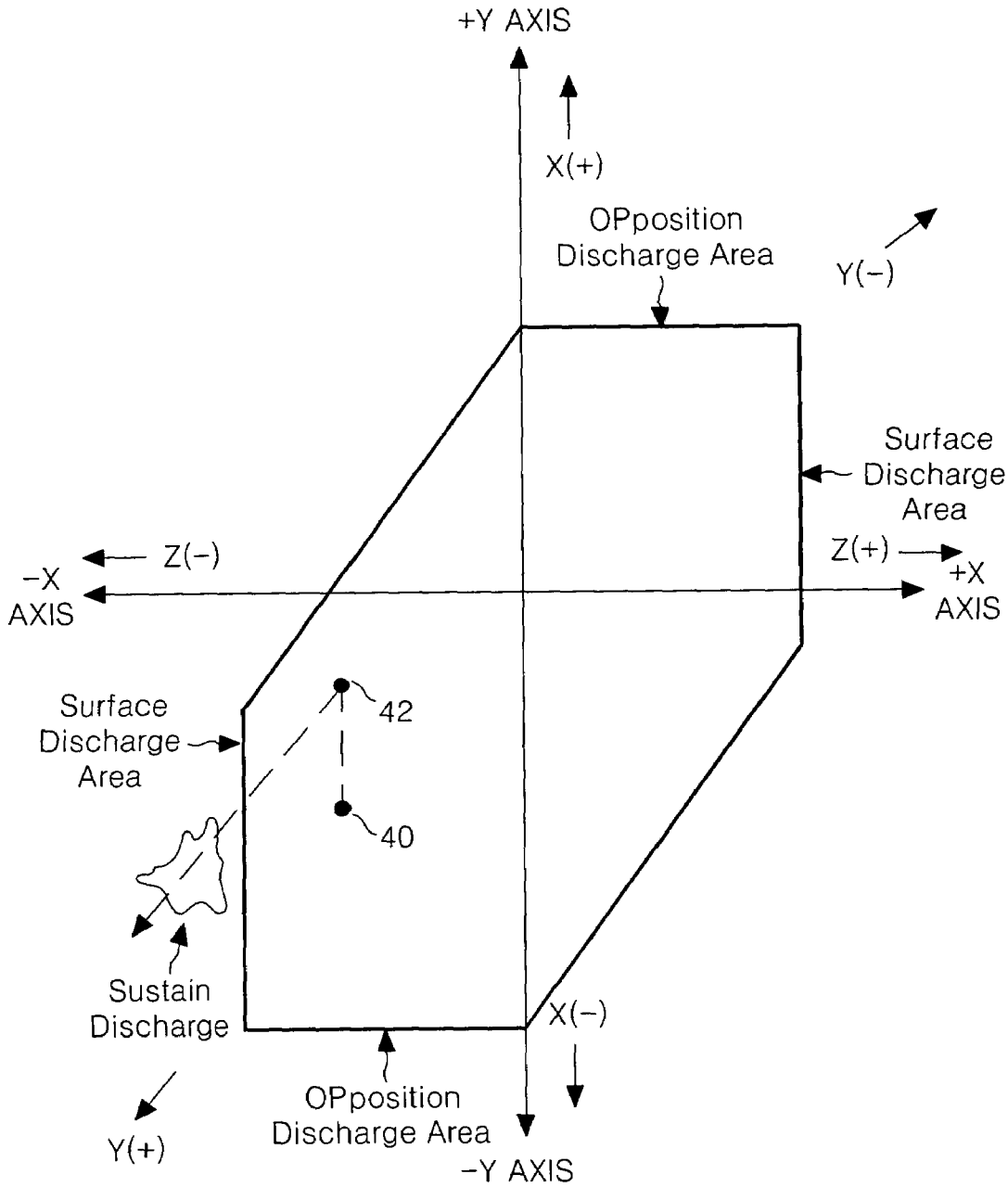
FIG. 11A and FIG. 11B are graphs showing a process of generating the sustain discharge by the waveforms of FIG. 10.
Figure 11B:
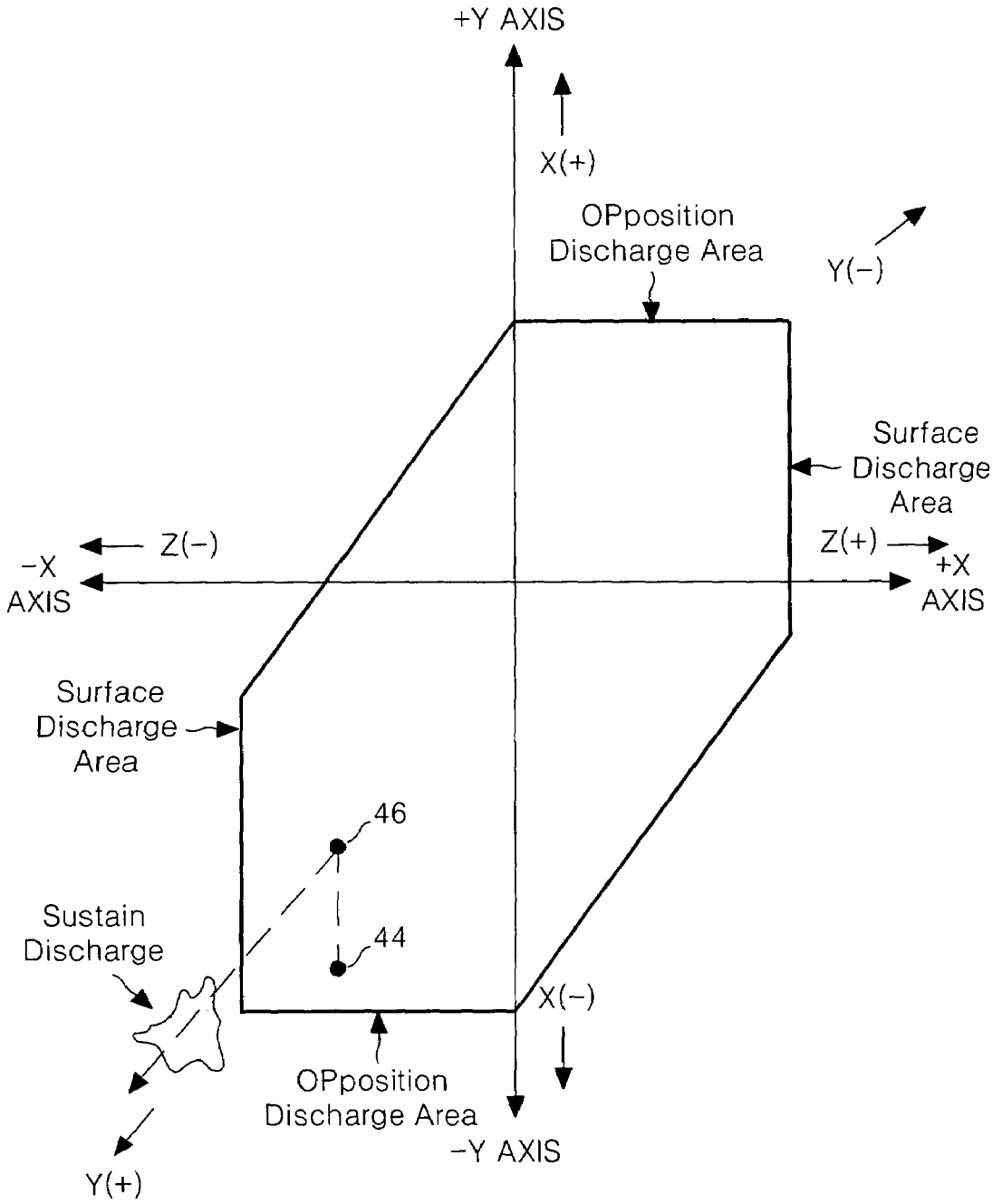

Meanwhile, there will be described an operation procedure when a data pulse data having a high voltage (i.e., more than 80V) is applied in the address period for the sake of a non-uniformity of the PDP cell or a high-speed addressing, that is, when the wall charges is positioned at the lower side 44 of the third quarter-face of the graph (i.e., a place being adjacent to the opposition discharge area) as shown in FIG. 11B below.

The wall voltage of the discharge cell is moved into a place 48 of the Y axis of the graph (i.e., into the X(+) axis) by the stabilization pulse SP applied to the address electrode X in the sustain period. Further, the wall voltage of the discharge cell is moved via the surface-discharge area (i.e., into the Y(+) axis) by the first sustaining pulse applied in such a manner to overlap with the stabilization pulse SP. In this case, at the discharge cells, a sustain discharge is generated between the scan electrode Y and the sustain electrode Z. In other words, the first embodiment of the present invention can cause a stable sustain discharge irrespectively of an non-uniformity of the discharge cell and/or a voltage of the data pulse data. If a sustain discharge having a surface-discharge type is generated at the discharge cells as mentioned above, then the wall charges of the discharge cell are moved into a desired place of the first quarter-face of the graph as shown in FIG. 6, thereby causing a stable sustain discharge.

Figure 12:
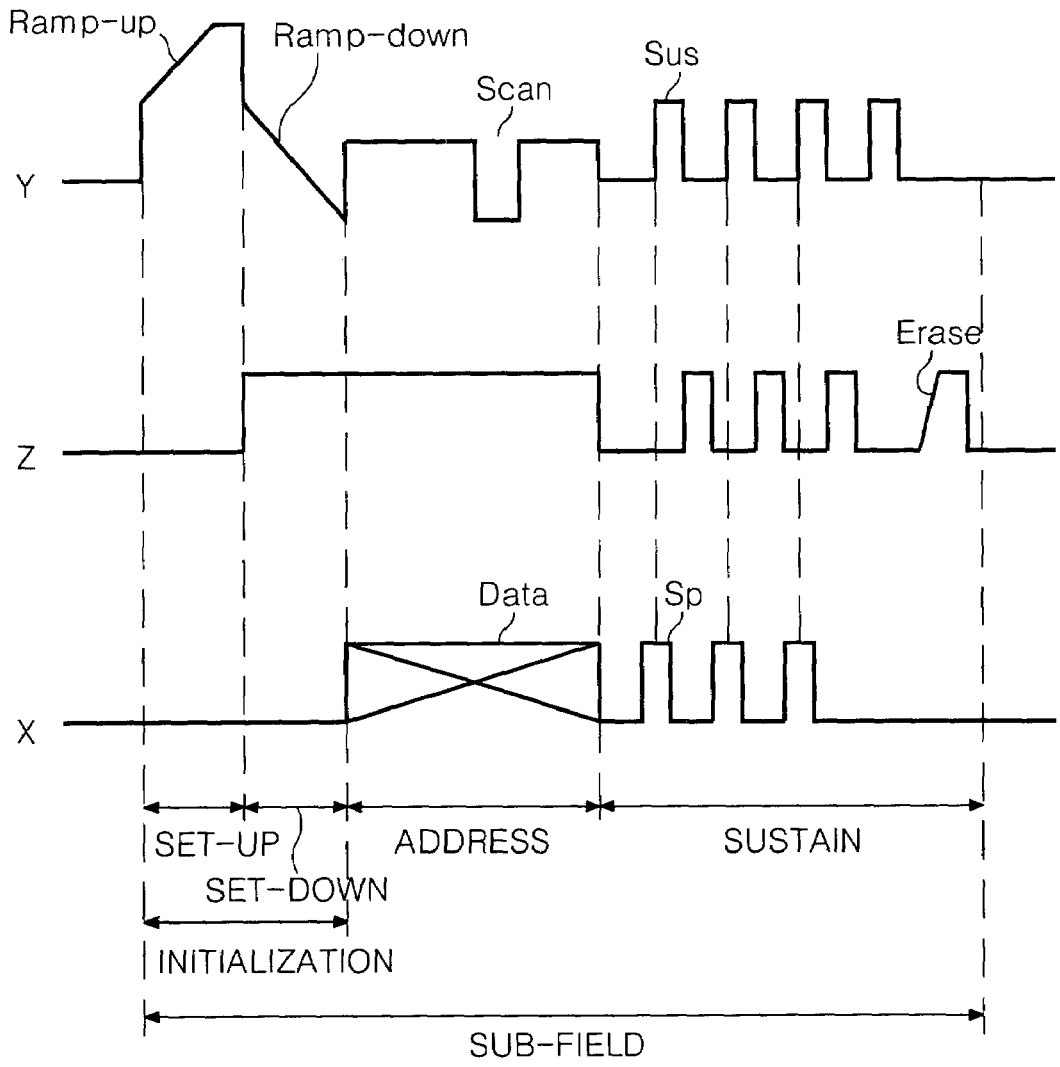
FIG. 12 is a waveform diagram for explaining a method of driving a plasma display panel according to a second embodiment of the present invention.

FIG. 12 is a waveform diagram for explaining a method of driving a plasma display panel according to a second embodiment of the present invention. In connection with FIG. 12, a detailed explanation as to the initialization period and the address period in which the same waveform as FIG. 10 is applied will be omitted.

Referring to FIG. 12, a sub-field of the PDP according to the second embodiment of the present invention is divided into an initialization period for initializing the full field, an address period for selecting a cell, and a sustain period for sustaining a discharge of the selected cell for its driving.

In the initialization period, wall charges required for the address discharge are uniformly left within the cells of the full field. In the address period, the discharge cells at which a sustain discharge is to be generated are selected in correspondence with a data.

In the sustain period, a positive sustaining pulse sus is alternately applied to the scan electrodes Y and the sustain electrodes Z. Further, a stabilization pulse SP overlapping with the sustaining pulse applied to the scan electrodes Y is applied to the address electrode X. Herein, the stabilization pulse SP applied to the address electrode X precedes the sustaining pulse applied to the scan electrodes Y. If the stabilization pulse SP overlapping with the sustaining pulse applied to the scan electrodes Y is applied to the address electrode X, then a stable sustain discharge having a surface-discharge type is generated in the sustain period.

Hereinafter, this will be described in detail with the aid of FIG. 11A and FIG. 11B.

Firstly, when wall charges are moved into a predetermined place 40 as shown in FIG. 11A by the address discharge, the wall charges are moved into a place at the Y axis of the graph (i.e., into the X(+) axis) by the stabilization pulse SP applied to the address electrode X (i.e., a voltage equal to or lower than a voltage of the data pulse data). Further, the wall charges of the discharge cell are moved via the surface-discharge area positioned at the third quarter-face of the graph (i.e., into the Y(+) axis) by the sustaining pulse applied to the scan electrodes Y in such a manner to overlap with the stabilization pulse SP. In this case, at the discharge cells, a sustain discharge is generated between the scan electrode Y and the sustain electrode Z. If a sustain discharge having a surface-discharge type is generated at the discharge cells as mentioned above, then the wall charges of the discharge cell are moved into a desired place of the first quarter-face of the graph as shown in FIG. 6, thereby causing a stable sustain discharge.

Meanwhile, if a data pulse data having a high voltage (i.e., more than 80V) is applied in the address period for the sake of a non-uniformity of the PDP cell or a high-speed addressing, then the wall charges are positioned at the lower side 44 of the third quarter-face of the graph (i.e., a place being adjacent to the opposition discharge area) as shown in FIG. 11B. Herein, if the stabilization pulse SP is applied to the address electrode X, then a voltage of the discharge cell is moved into a place 46 at the Y axis (i.e., into the X(+) axis). Further, if a sustaining pulse is applied to the scan electrode Y in such a manner to overlap with the stabilization pulse SP, then the wall voltage is moved via the surface-discharge area (i.e., into the Y(+) axis). In this case, at the discharge cells, a sustain discharge is generated between the scan electrode Y and the sustain electrode Z. In other words, the second embodiment of the present invention can cause a stable sustain discharge irrespectively of an non-uniformity of the discharge cell and/or a voltage of the data pulse data. Thereafter, if a sustain discharge having a surface-discharge type is generated at the discharge cells as mentioned above, then the wall charges of the discharge cell are moved into a desired place of the first quarter-face of the graph as shown in FIG. 6, thereby causing a stable sustain discharge.

Figure 13A:
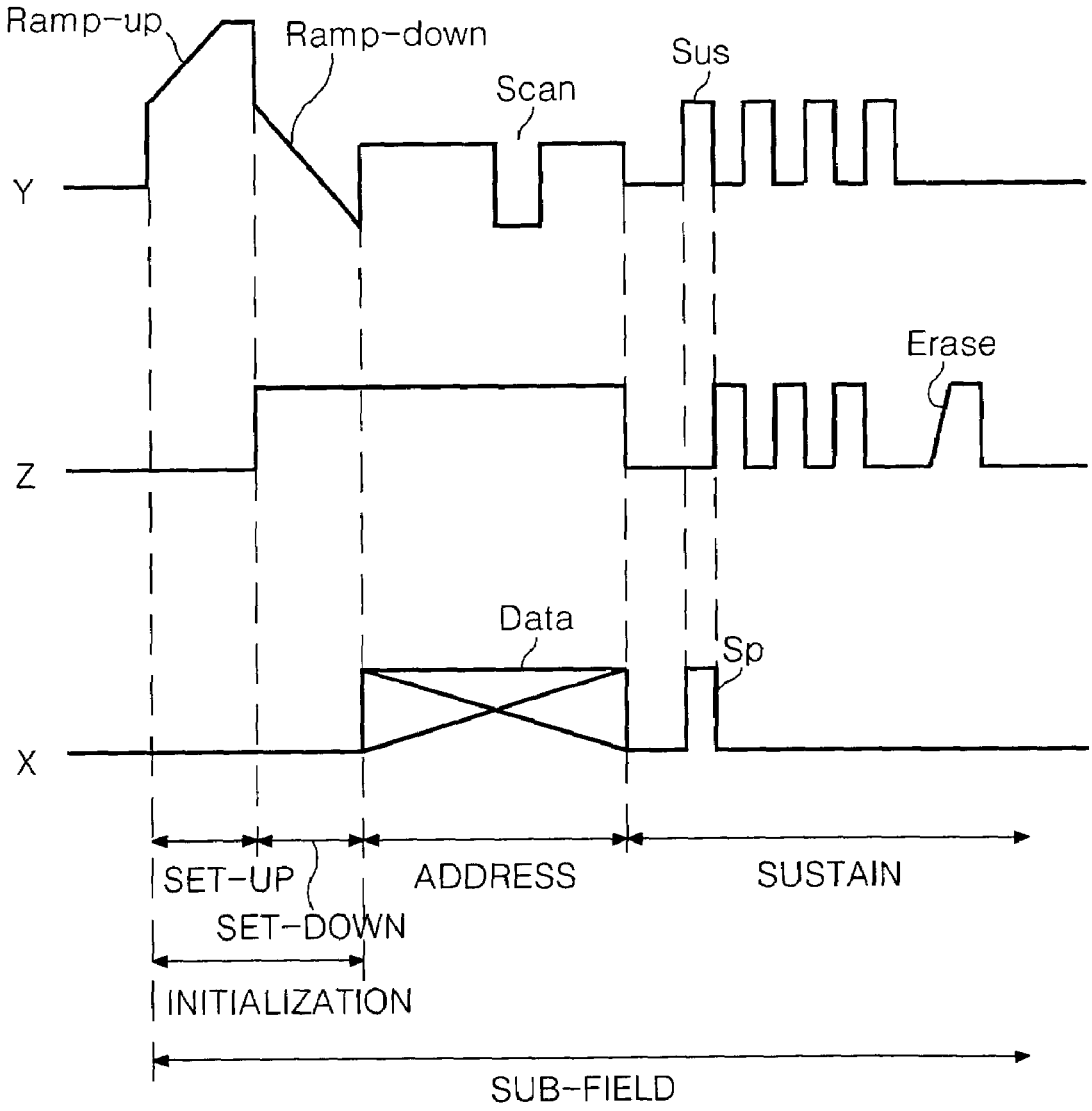
FIG. 13A to FIG. 13D are waveform diagrams for explaining modified embodiments of the first and second embodiments of the present invention.
Figure 13B:
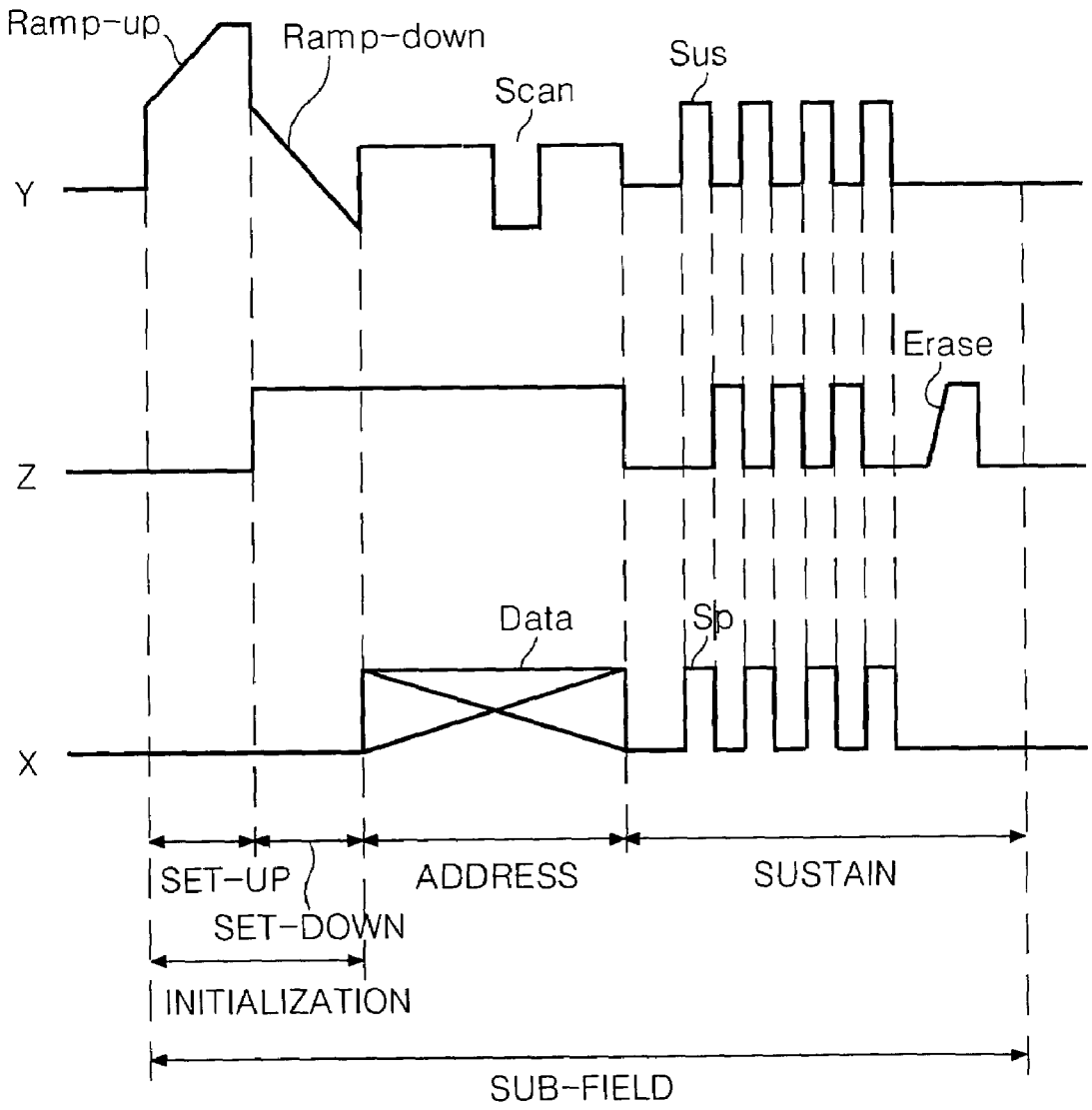
Figure 13C:
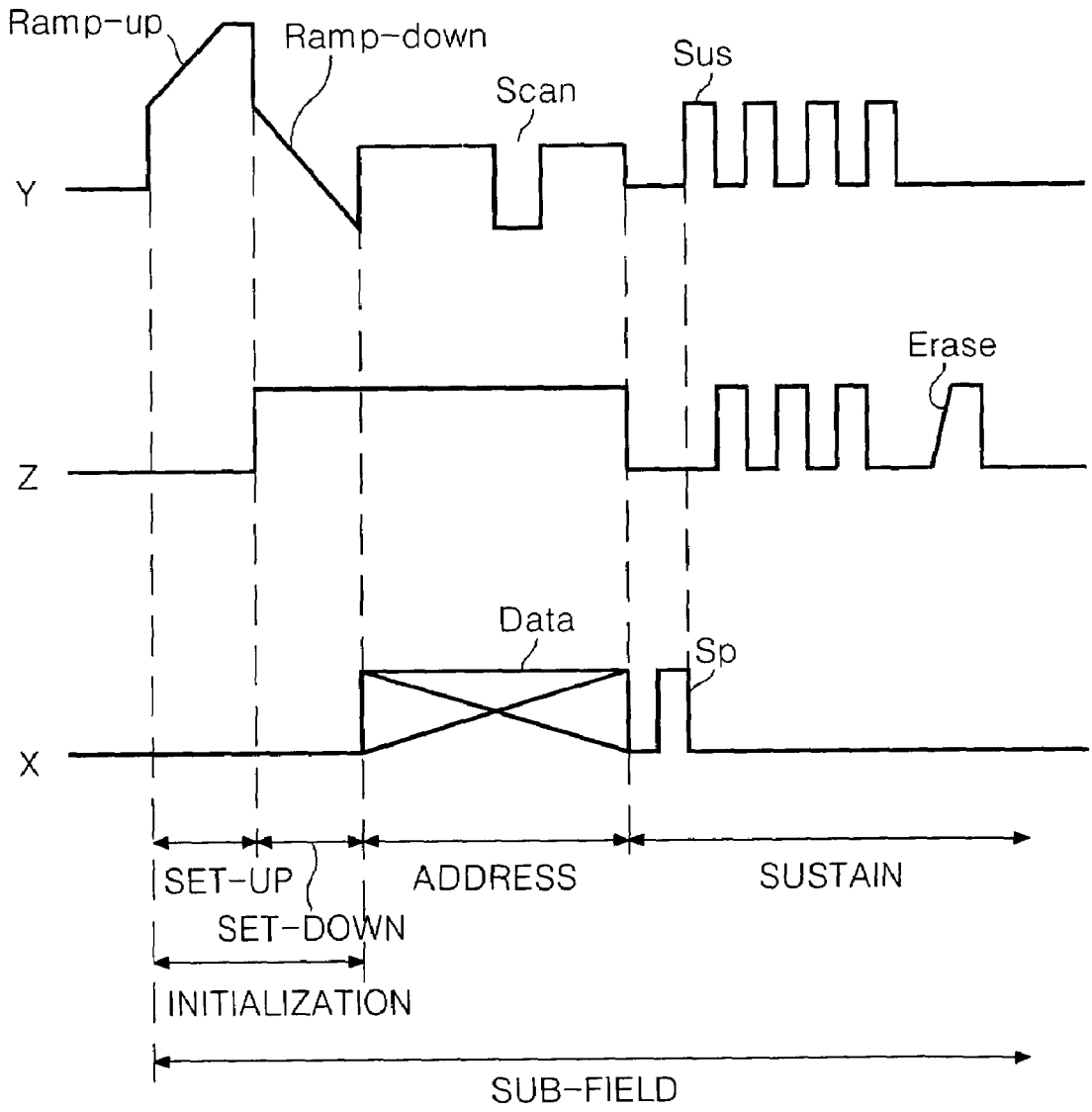
Figure 13D:
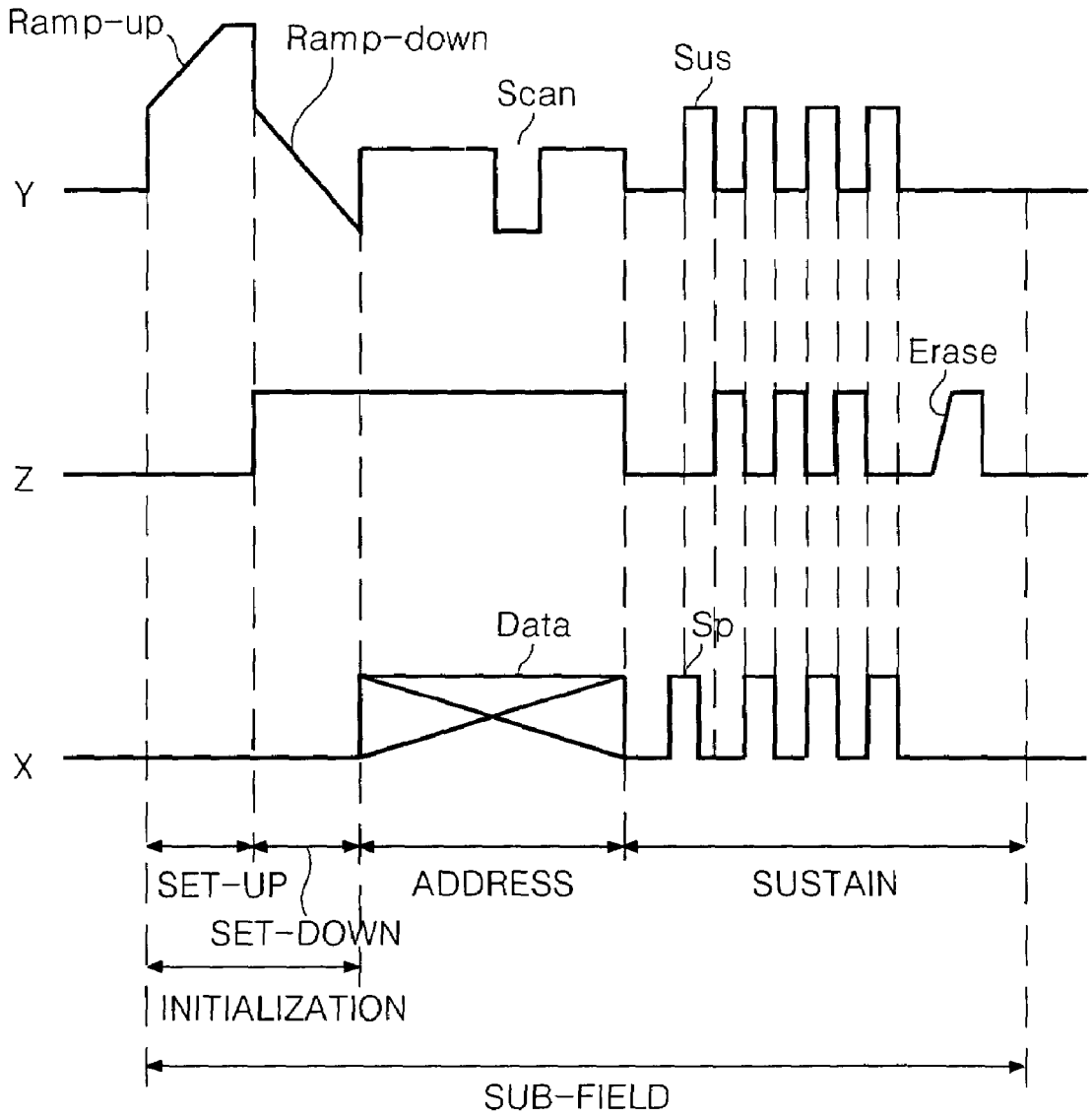

Alternatively, the first and second embodiments of the present invention shown in FIG. 10 and FIG. 12 can be modified into various types. For instance, as shown in FIGS. 13A and 13B, the stabilization pulse SP applied to the address electrode X may be synchronized with the sustaining pulse applied to the scan electrode Y. If the stabilization pulse SP and the sustaining pulse applied to the scan electrode Y are synchronized with each other, then it becomes possible to cause a stable sustain discharge as shown in FIG. 11A and FIG. 11B. Otherwise, the stabilization pulse SP may be applied prior to the sustaining pulse in such a manner to be not overlapped with the (first) sustaining pulse applied to the scan electrode Y as shown in FIG. 13C. Furthermore, as shown in FIG. 13D, the first sustaining pulse and the first stabilization pulse SP may overlap with each other while the stabilization pulse SP applied later may be synchronized with the sustaining pulse applied to the scan electrode Y. In other words, according to the present invention, it becomes possible to cause a stable sustain discharge irrespectively of an non-uniformity of the discharge cells and/or a voltage of the data pulse data.

Figure 14:
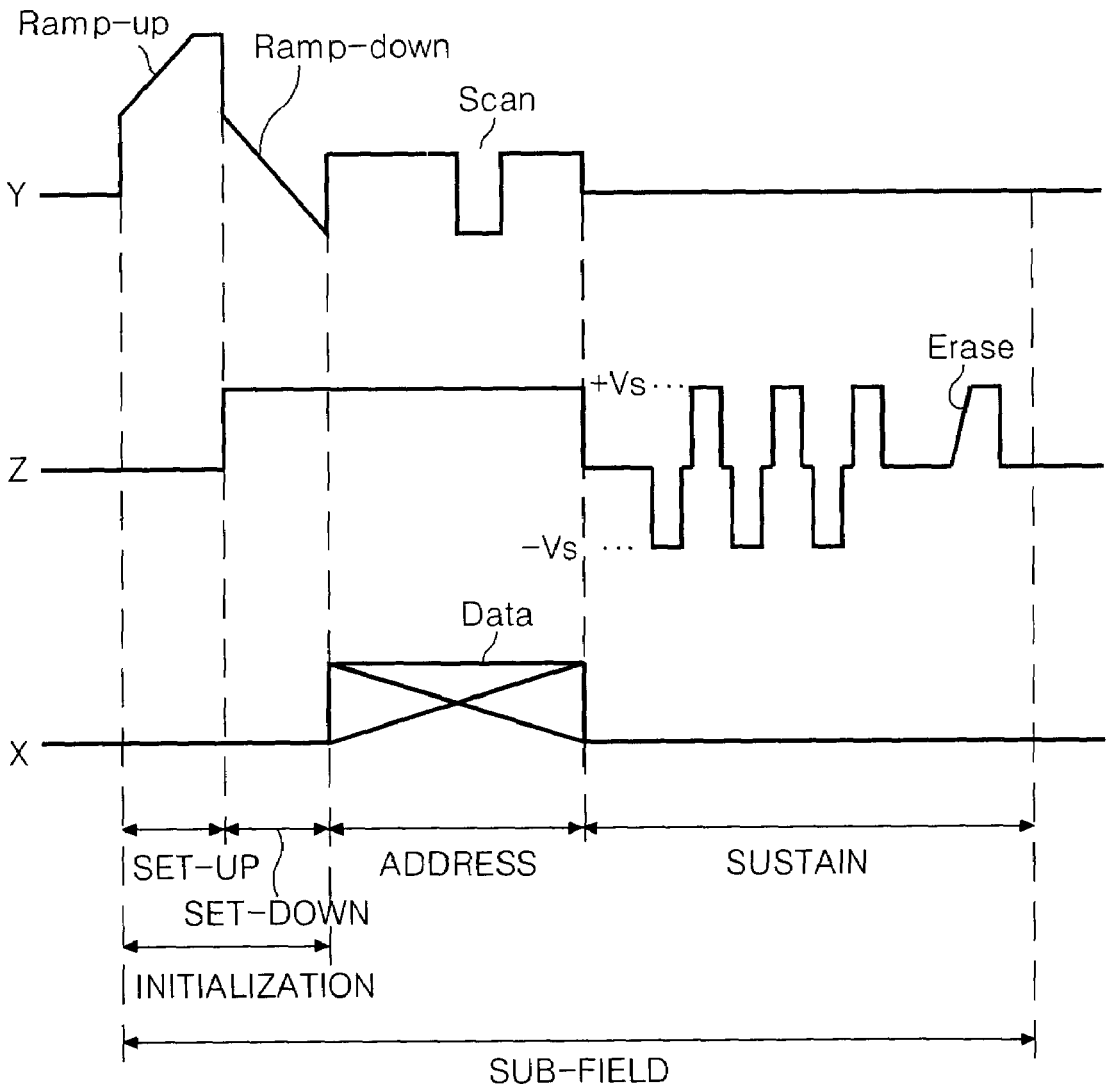
FIG. 14 is a waveform diagram for explaining a method of driving a plasma display panel according to a third embodiment of the present invention.

FIG. 14 is a waveform diagram for explaining a method of driving a plasma display panel according to a third embodiment of the present invention. In connection with FIG. 14, a detailed explanation as to the initialization period and the address period in which the same waveform as FIG. 10 is applied will be omitted.

Referring to FIG. 14, a sub-field of the PDP according to the third embodiment of the present invention is divided into an initialization period for initializing the full field, an address period for selecting a cell, and a sustain period for sustaining a discharge of the selected cell for its driving.

In the initialization period, wall charges required for the address discharge are uniformly left within the cells of the full field. In the address period, the discharge cells at which a sustain discharge is to be generated are selected in correspondence with a data.

In the sustain period, negative and positive sustaining pulses −Vs and +Vs are repetitively applied to the sustain electrodes Z. At this time, the scan electrodes Y and the address electrodes X are not supplied with any pulse. In other words, they maintain a ground potential. If the negative and positive sustaining pulse −Vs and +Vs are repetitively applied to the sustain electrodes Z, then a stable sustain discharge having a surface-discharge type can be generated in the sustain period.

Hereinafter, this will be described in detail with the aid of FIG. 15A and FIG. 15B.

Figure 15A:
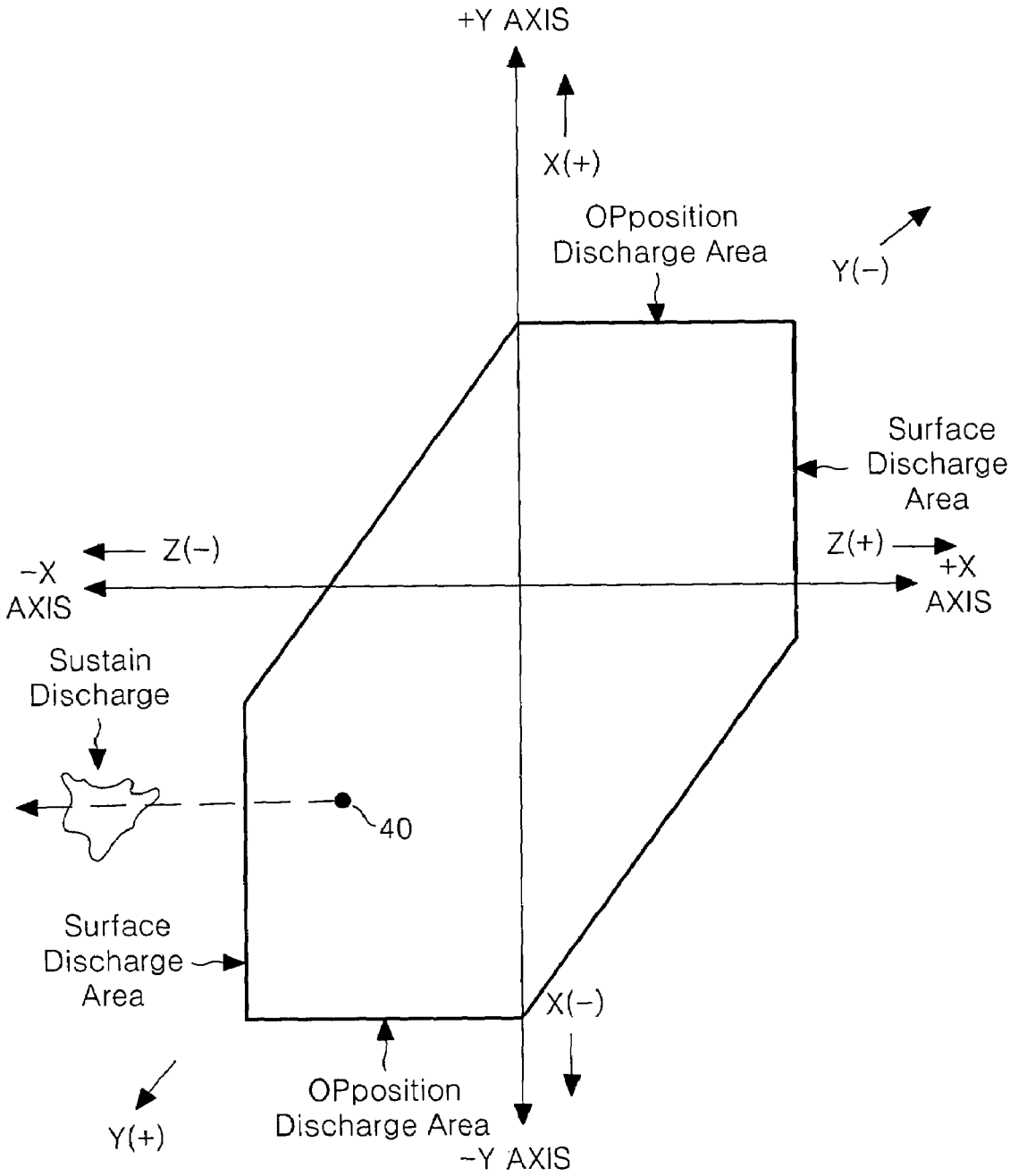
FIG. 15A and FIG. 15B are graphs showing a process of generating the sustain discharge by the waveforms of FIG. 14.

Firstly, when wall charges are moved into a predetermined place 40 as shown in FIG. 15A by the address discharge, a voltage of the discharge cell is moved via the surface-discharge area (i.e., into the Z(−) axis) by the negative sustaining pulse −Vs applied to the sustain electrodes Z. In this case, at the discharge cells, a sustain discharge is generated between the scan electrode Y and the sustain electrode Z. If a sustain discharge having a surface-discharge type is generated at the discharge cells as mentioned above, then the wall charges of the discharge cell are moved into a desired place of the first quarter-face of the graph as shown in FIG. 6. Then, a sustain discharge having a surface-discharge type is generated by the positive sustaining pulse +Vs applied to the sustain electrodes Z. Thereafter, the foregoing process is repeated to cause a stable sustain discharge.

Figure 15B:
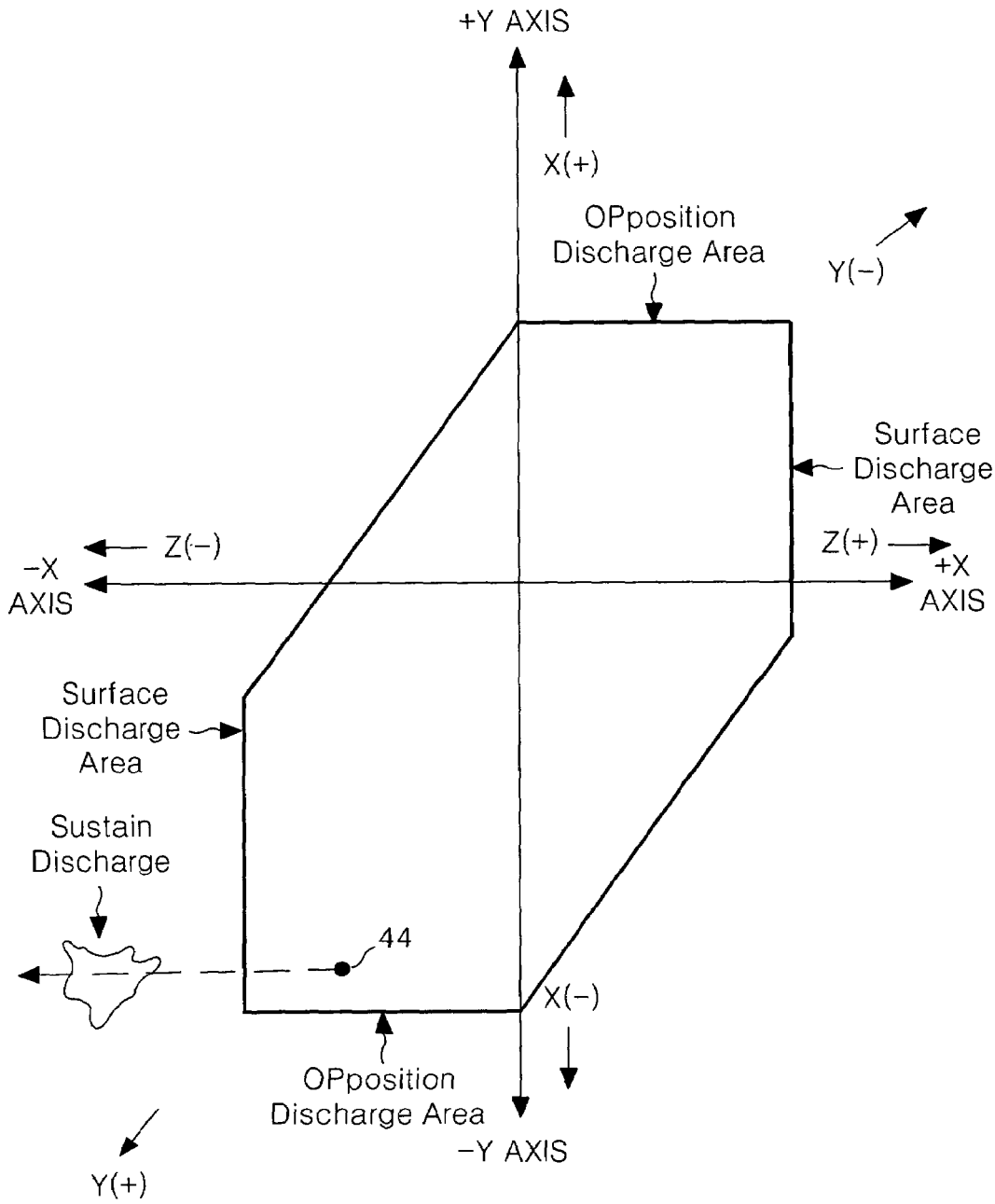

Meanwhile, if a data pulse data having a high voltage (i.e., more than 80V) is applied in the address period for the sake of a non-uniformity of the PDP cell or a high-speed addressing, then the wall charges are positioned at the lower side 44 of the third quarter-face of the graph (i.e., a place being adjacent to the opposition discharge area) as shown in FIG. 15B. Herein, if the negative sustaining pulse −Vs is applied to the sustain electrode Z, then a voltage of the discharge cell is moved via the surface-discharge area (i.e., into the Z(−) axis). In this case, at the discharge cells, a sustain discharge is generated between the scan electrode Y and the sustain electrode Z. If a sustain discharge having a surface-discharge type is generated at the discharge cells as mentioned above, then the wall charges of the discharge cell are moved into a desired place of the first quarter-face of the graph as shown in FIG. 6. Then, a sustain discharge having a surface-discharge type is generated by the positive sustaining pulse +Vs applied to the sustain electrodes Z. Thereafter, the foregoing process is repeated to cause a stable sustain discharge. In other words, the third embodiment of the present invention can cause a stable sustain discharge irrespectively of an non-uniformity of the discharge cells and/or a voltage of the data pulse data.

Figure 16:
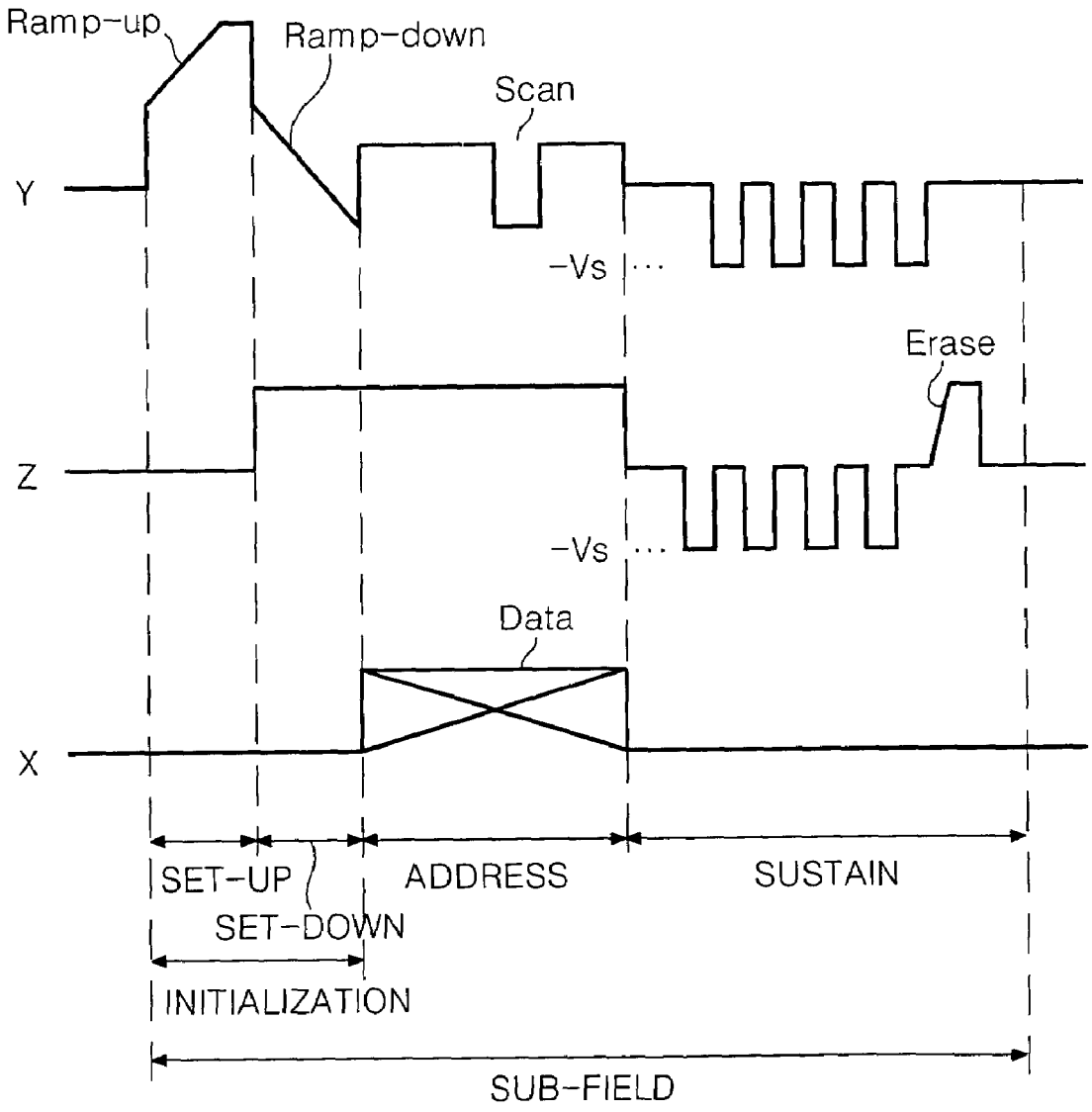
FIG. 16 is a waveform diagram for explaining a method of driving a plasma display panel according to a fourth embodiment of the present invention.

FIG. 16 is a waveform diagram for explaining a method of driving a plasma display panel according to a fourth embodiment of the present invention. In connection with FIG. 16, a detailed explanation as to the initialization period and the address period in which the same waveform as FIG. 10 is applied will be omitted.

Referring to FIG. 16, a sub-field of the PDP according to the fourth embodiment of the present invention is divided into an initialization period for initializing the full field, an address period for selecting a cell, and a sustain period for sustaining a discharge of the selected cell for its driving.

In the initialization period, wall charges required for the address discharge are uniformly left within the cells of the full field. In the address period, the discharge cells at which a sustain discharge is to be generated are selected in correspondence with a data.

In the sustain period, a negative sustaining pulse −Vs is alternately applied to the sustain electrodes Z and the scan electrodes Y. If the negative sustaining pulse −Vs is alternately applied to the sustain electrodes Z and the scan electrodes Y, then a stable sustain discharge having a surface-discharge type is generated in the sustain period.

This will be described in detail below.

Firstly, if the negative sustaining pulse −Vs is applied to the sustain electrode Z, a voltage of the discharge cell is moved via the surface-discharge area (i.e., into the Z(−) axis), as shown in FIG. 15A and FIG. 15B, irrespectively of a forming position of wall charges. In this case, at the discharge cells, a sustain discharge is generated between the scan electrode Y and the sustain electrode Z. If a sustain discharge having a surface-discharge type is generated at the discharge cells as mentioned above, then the wall charges of the discharge cell are moved into a desired place of the first quarter-face of the graph as shown in FIG. 17.

Figure 17:
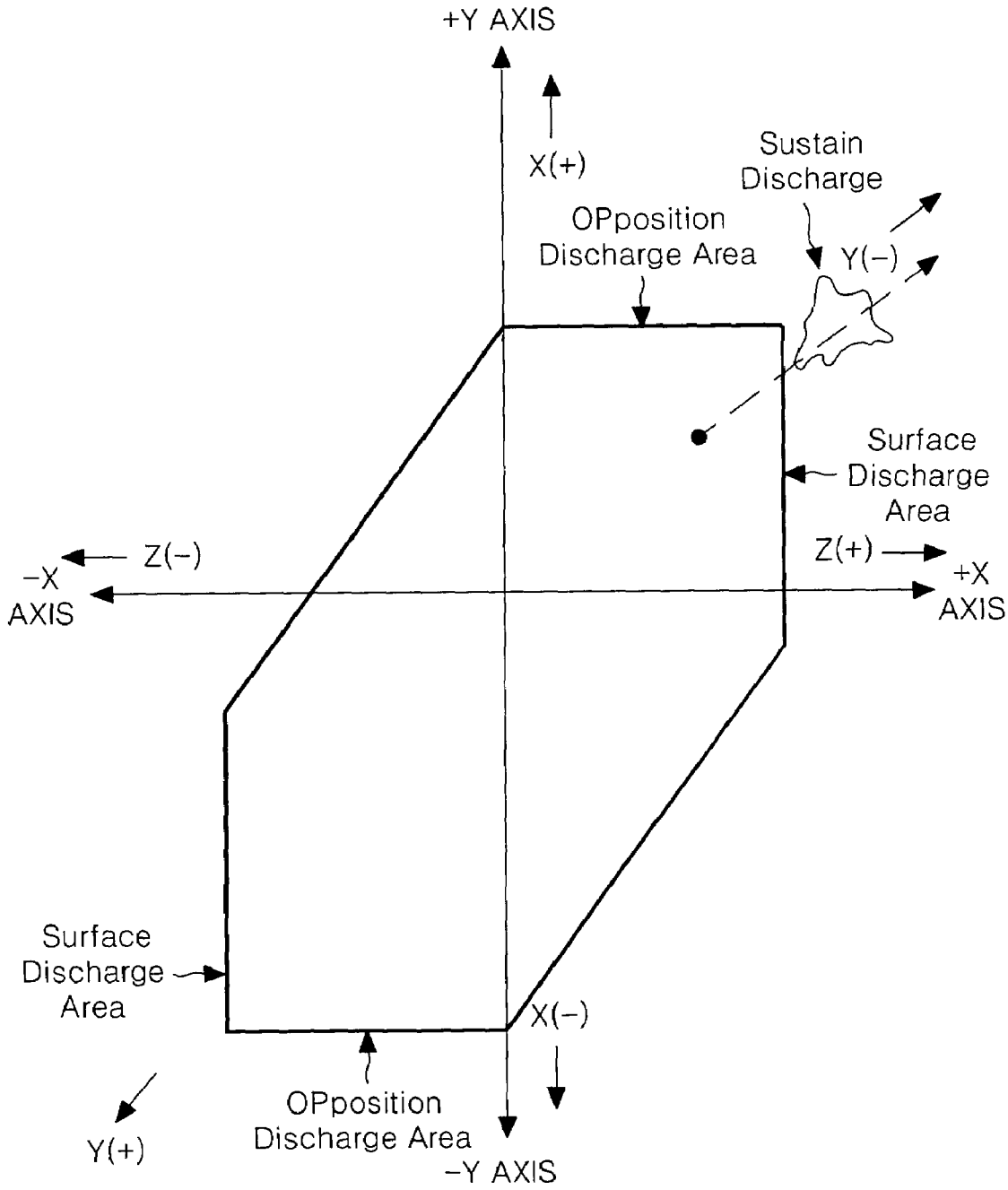
FIG. 17 is a graph showing a process of generating the sustain discharge by the waveforms of FIG. 16.

Thereafter, if the negative sustaining pulse −Vs is applied to the scan electrode Y, then a voltage of the discharge cell is moved via the surface-discharge area of the first quarter-face of the graph (i.e., into the Y(+) axis) as shown in FIG. 17. In this case, at the discharge cells, a sustain discharge is generated between the scan electrode Y and the sustain electrode Z. Thereafter, the foregoing process is repeated to cause a stable sustain discharge. In other words, the fourth embodiment of the present invention can cause a stable sustain discharge irrespectively of an non-uniformity of the discharge cells and/or a voltage of the data pulse data.

Figure 18:
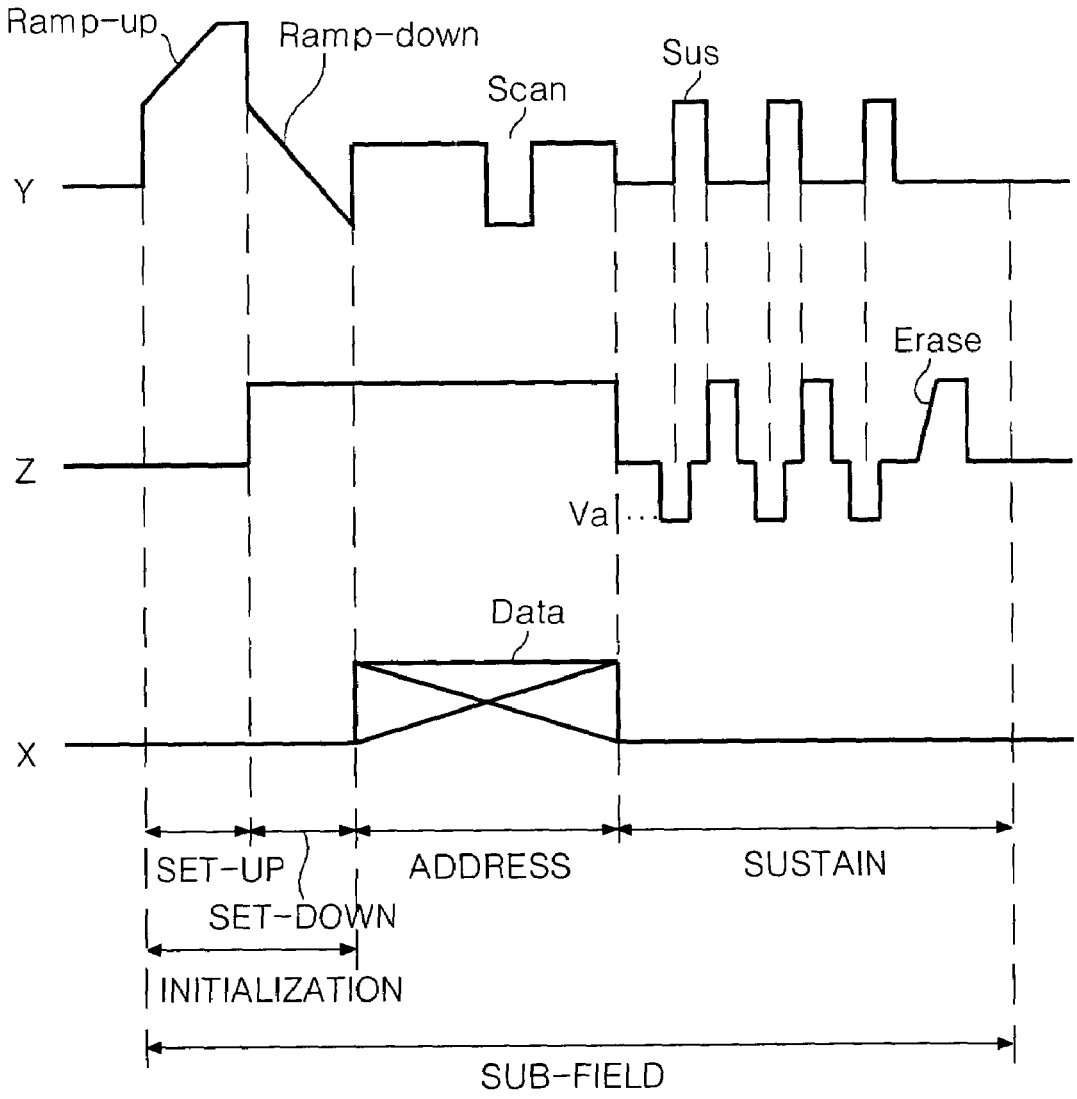
FIG. 18 is a waveform diagram for explaining a method of driving a plasma display panel according to a fifth embodiment of the present invention.

FIG. 18 is a waveform diagram for explaining a method of driving a plasma display panel according to a fifth embodiment of the present invention. In connection with FIG. 18, a detailed explanation as to the initialization period and the address period in which the same waveform as FIG. 10 is applied will be omitted.

Referring to FIG. 18, a sub-field of the PDP according to the fifth embodiment of the present invention is divided into an initialization period for initializing the full field, an address period for selecting a cell, and a sustain period for sustaining a discharge of the selected cell for its driving.

In the initialization period, wall charges required for the address discharge are uniformly left within the cells of the full field. In the address period, the discharge cells at which a sustain discharge is to be generated are selected in correspondence with a data.

In the sustain period, a positive sustaining pulse is alternately applied to the scan electrodes Y and the sustain electrodes Z. Further, a stabilization pulse Va applied prior to the positive sustaining pulse applied to the scan electrodes Y and overlapping with a portion of the positive sustaining pulse applied to the scan electrodes Y is applied to the sustain electrodes Z. Herein, an absolute voltage value of the stabilization pulse Va is set to be lower than that of the sustaining pulse. If the negative stabilization pulse Va and the positive sustaining pulse are applied to the sustain electrodes Z and the positive sustaining pulse is applied to the scan electrodes Y, then a stable sustain discharge having a surface-discharge type can be generated in the sustain period.

Hereinafter, this will be described in detail with the aid of FIG. 19A and FIG. 19B.

Figure 19A:
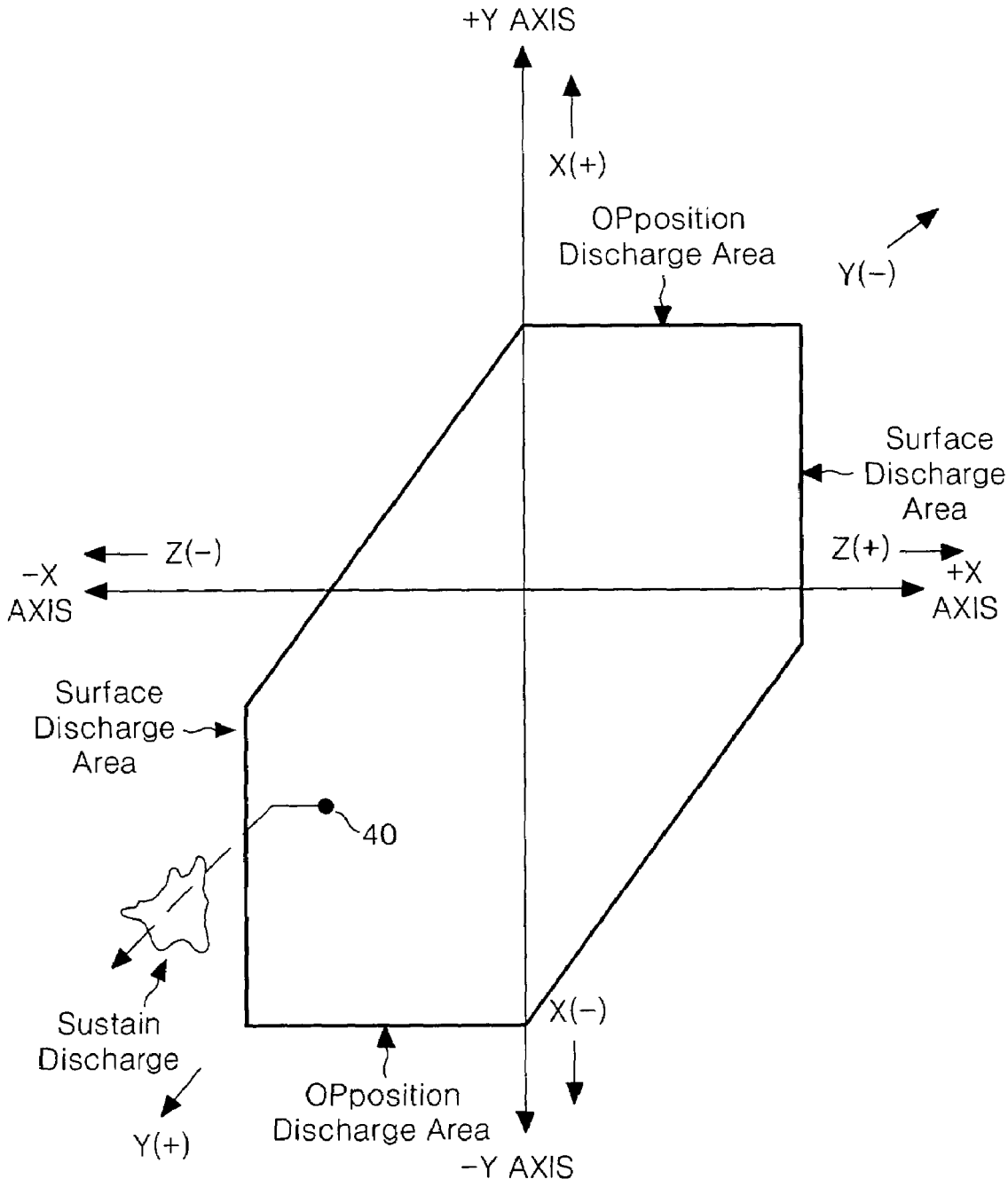
FIG. 19A and FIG. 19B are graphs showing a process of generating the sustain discharge by the waveforms of FIG. 18.

Firstly, when wall charges are moved into a predetermined place 40 as shown in FIG. 19A by the address discharge, a voltage of the discharge cell is moved via the surface-discharge area at the third quarter-face of the graph (i.e., into the Z(−) axis) by the negative stabilization pulse Va applied to the sustain electrodes Z. Furthermore, a voltage moved toward the surface-discharge area at the third quarter-face of the graph is moved via the surface-discharge area at the third quarter-face of the graph (i.e., into the Y(+) axis) by the positive sustaining pulse applied to the scan electrode Y. In this case, at the discharge cells, a sustain discharge is generated between the scan electrode Y and the sustain electrode Z. If a sustain discharge having a surface-discharge type is generated at the discharge cells as mentioned above, then the wall charges of the discharge cell are moved into a desired place of the first quarter-face of the graph as shown in FIG. 6. Then, a sustain discharge having a surface-discharge type is generated by the positive sustaining pulse applied to the sustain electrodes Z. Thereafter, the foregoing process is repeated to cause a stable sustain discharge.

Figure 19B:
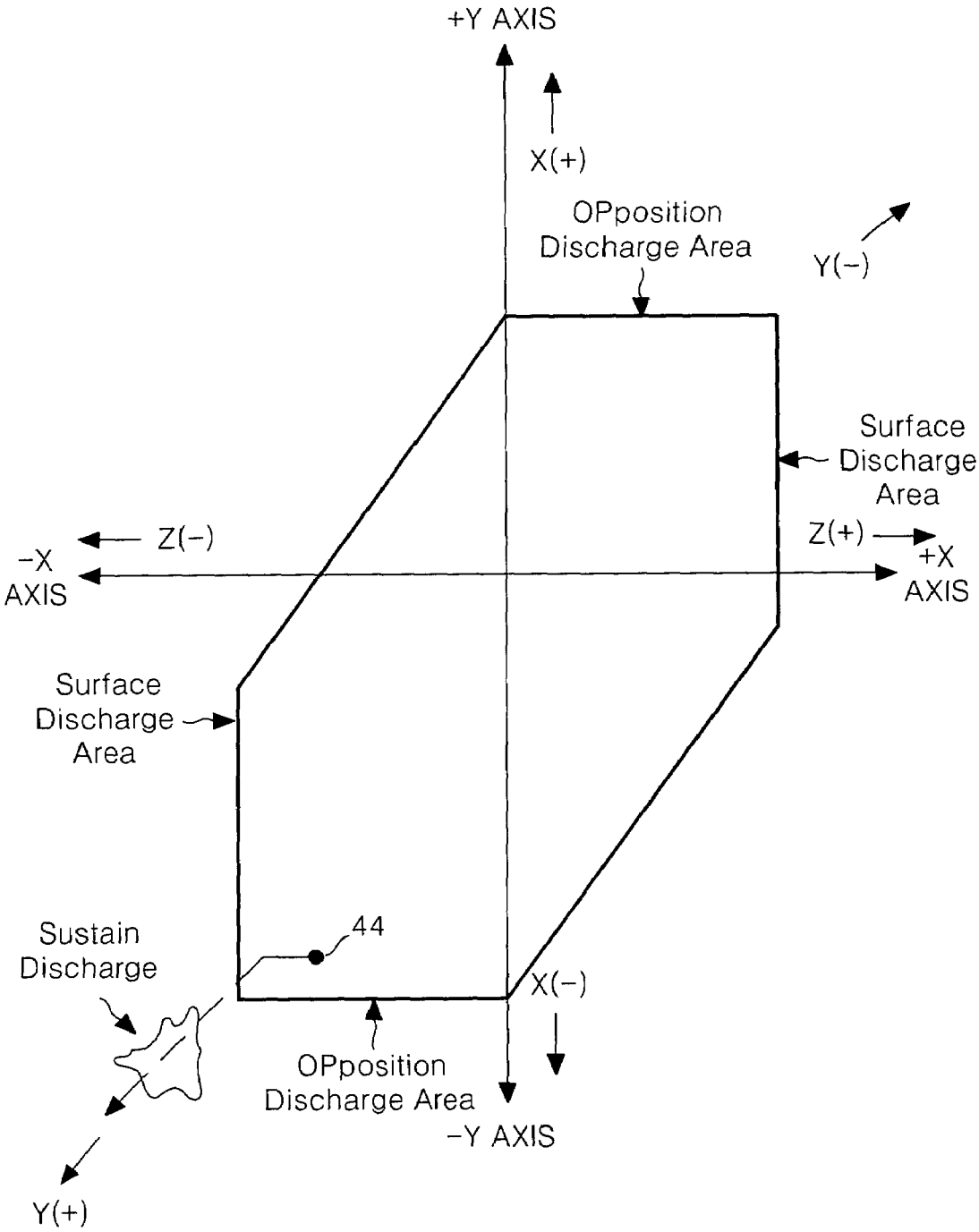

Meanwhile, if a data pulse data having a high voltage (i.e., more than 80V) is applied in the address period for the sake of a non-uniformity of the PDP cell or a high-speed addressing, then the wall charges are positioned at the lower side 44 of the third quarter-face of the graph (i.e., a place being adjacent to the opposition discharge area) as shown in FIG. 19B. Herein, a voltage of the discharge cell is moved into the surface-discharge area at the third quarter-face of the graph (i.e., into the Z(−) axis) by the negative stabilization pulse Va applied to the sustain electrodes Z. Furthermore, a voltage moved toward the surface-discharge area at the third quarter-face of the graph is moved via the surface-discharge area at the third quarter-face of the graph (i.e., into the Y(+) axis) by the positive sustaining pulse applied to the scan electrode Y. In this case, at the discharge cells, a sustain discharge is generated between the scan electrode Y and the sustain electrode Z. If a sustain discharge having a surface-discharge type is generated at the discharge cells as mentioned above, then the wall charges of the discharge cell are moved into a desired place of the first quarter-face of the graph as shown in FIG. 6. Then, a sustain discharge having a surface-discharge type is generated by the positive sustaining pulse applied to the sustain electrodes Z. Thereafter, the foregoing process is repeated to cause a stable sustain discharge. In other words, the fifth embodiment of the present invention can cause a stable sustain discharge irrespectively of an non-uniformity of the discharge cells and/or a voltage of the data pulse data.

As described above, according to the present invention, a stable sustain discharge can be generated even though an non-uniformity of the discharge cells exist and a high voltage of sustaining pulse is applied. In other words, according to the present invention, a waveform in the sustain period is set such that a voltage of the discharge cell can go through the surface-discharge area of the voltage close curve irrespectively of a position of wall charges formed by the address discharge, thereby causing a stable sustain discharge. Furthermore, according to the present invention, a stable sustain discharge can be generated irrespectively of a position of wall charges formed by the address discharge, so that it becomes possible to apply a high voltage of data pulse for the sake of making a high-speed addressing operation.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel in which each of a plurality of discharge cells has a scan electrode and a sustain electrode arranged in parallel to each other, said method comprising:

applying one or more first sustaining pulses to the scan electrode of a discharge cell;

applying one or more second sustaining pulses to the sustain electrode of the discharge cell, the second sustaining pulses applied alternately with the first sustaining pulses to induce generation of a sustain discharge; and applying a stabilization pulse to an address electrode of the discharge cell, said stabilization pulse applied to overlap one of the first sustaining pulses applied to the scan electrode, said method further comprising:

applying a number of additional stabilization pulses to the address electrode, the additional stabilization pulses overlapping an equal number of the plurality of first sustaining pulses respectively applied to the scan electrodes.

2. The method as claimed in claim 1, wherein said stabilization pulse overlaps with a portion of a first sustaining pulse firstly applied to the scan electrode.

3. The method as claimed in claim 2, wherein said stabilization pulse is applied prior to the firstly-applied first sustaining pulse.

4. The method as claimed in claim 1, wherein said stabilization pulse is synchronized with said one of the first sustaining pulses applied to the scan electrode.

5. The method as claimed in claim 1, wherein said stabilization pulse has a positive voltage.

6. The method as claimed in claim 1 , wherein said stabilization pulse overlaps with only a portion of said first one of the first sustaining pulses.

7. The method as claimed in claim 6, wherein said stabilization pulse is applied prior to said first one of the first sustaining pulses.

8. The method as claimed in claim 1 , wherein said first one of the stabilization pulses and said additional stabilization pulses are synchronized with said first one of the first sustaining pulses and said equal number of the first sustaining pulses respectively.

9. The method as claimed in claim 8, wherein leading and trailing edges of said first one of the stabilization pulses substantially coincide with leading and trailing edges of said first one of the first sustaining pulses, and wherein leading and trailing edges of said additional stabilization pulses are synchronized with leading and trailing edges of respective ones of said equal number of the first sustaining pulses.

10. The method as claimed in claim 1 , wherein a first sustaining pulse firstly applied to the scan electrode overlaps with a partial interval of said stabilization pulse, and wherein said equal number of the first sustaining pulses are synchronized with said additional stabilization pulses respectively.

11. The method as claimed in claim 10, wherein leading and trailing edges of said additional stabilization pulses are synchronized with leading and trailing edges of respective ones of said equal number of the first sustaining pulses.

12. The method as claimed in claim 1, further comprising:

applying a data pulse to the address electrode in order to select a discharge cell at which said sustain discharge is generated before generation of said sustain discharge.

13. The method as claimed in claim 1, wherein said stabilization pulse is applied to overlap at least one of the first sustaining pulses applied to the scan electrode to cause said sustain discharge to be generated via a surface-discharge area of a voltage close curve.

14. The method as claimed in claim 1, wherein said stabilization pulse is synchronized with a first one of the first sustaining pulses applied to the scan electrode, such that a leading edge of the stabilization pulse substantially coincides with a leading edge of the first one of the first sustaining pulses applied to the scan electrode, and such that a trailing edge of the stabilization pulse substantially coincides with a trailing edge of the first one of the first sustaining pulse applied to the scan electrode.

15. The method as claimed in claim 1, further comprising:

applying a data pulse to the address electrode during an address period, wherein a magnitude of said stabilization pulse is less than or substantially equal to a magnitude of the data pulse applied to the address electrode.

16. A method of driving a plasma display panel in which each of a plurality of discharge cells has a scan electrode and a sustain electrode arranged in parallel to each other, said method comprising:

applying one or more first sustaining pulses to the scan electrode of a discharge cell;

applying one or more second sustaining pulses to the sustain electrode of the discharge cell, the second sustaining pulses applied alternately with the first sustaining pulses to induce generation of a sustain discharge; and applying a stabilization pulse to an address electrode of the discharge cell during a sustain period, wherein said stabilization pulse is applied prior to a first one of the first sustaining pulses in such a manner that said stabilization pulse is not overlapped with the first one of the first sustaining pulses applied to the scan electrode.

17. A method of driving a plasma display panel in which each of a plurality of discharge cells has a scan electrode and a sustain electrode arranged in parallel to each other and an address electrode provided alternately with the scan electrode, said method comprising:

repetitively applying negative and positive sustaining pulses to the sustain electrode of a discharge cell to induce generation of a sustain discharge during a sustain period, wherein the scan electrode and the address electrode maintain substantially a same potential during said sustain period.

18. The method as claimed in claim 17, wherein said negative sustaining pulse is applied as a first pulse in said sustain period.

19. The method as claimed in claim 17, wherein the scan electrode and the address electrode maintain a ground potential during said sustain period.

20. The method as claimed in claim 17, wherein said negative sustaining pu1ses and said positive sustaining pulses have substantially a same absolute voltage value.

21. The method as claimed in claim 17, wherein generation of the sustain discharge is induced via a surface discharge of a voltage close curve.

22. The method as claimed in claim 17, further comprising:

applying sustaining pulses of a same polarity to the scan electrode during the sustain period, the sustaining pulses applied to the scan electrode partially overlapping one of the negative sustaining pulses or the positive sustaining pulses applied to the sustain electrode respectively.

23. The method as claimed in claim 22, wherein the sustaining pulses applied to the scan electrode do not overlap the other of the negative sustaining pulses or the positive sustaining pulses applied to the sustain electrode respectively.

24. A method of driving a plasma display panel in which each of a plurality of discharge cells has a scan electrode and a sustain electrode arranged in parallel to each other, said method comprising:

applying first positive sustaining pulses to a scan electrode of a discharge cell to induce generation of a sustain discharge;

applying second positive sustaining pulses to a sustain electrode of the discharge cell alternately with the first sustaining pulses; and applying a stabilization pulse to the sustain electrode, wherein said stabilization pulse overlaps with a portion of at least one of the first sustaining pulses applied to the scan electrode.

25. The method as claimed in claim 24, wherein said stabilization pulse has a negative potential.

26. The method as claimed in claim 25, wherein an absolute voltage value of said stabilization pulse is set to be lower absolute values of said first and second sustaining pulses.

27. The method as claimed in claim 24, wherein said stabilization pulse is applied prior to a first one of the first sustaining pulses.

28. The method as claimed in claim 24, wherein generation of the sustain discharge is induced via a surface discharge area of a voltage close curve.

* * * * *